US008418678B2

(12) United States Patent
Ochi et al.

(10) Patent No.: US 8,418,678 B2
(45) Date of Patent: Apr. 16, 2013

(54) FUEL SYSTEM FOR TRAVELING VEHICLE

(75) Inventors: Kazuhiro Ochi, Sakai (JP); Masahiro Yamada, Sakai (JP); Hideya Umemoto, Sakai (JP); Eiji Satou, Sakai (JP); Yusuke Shoji, Sakai (JP); Kazuaki Nogami, Sakai (JP); Takeshi Komorida, Sakai (JP); Hiroyuki Tada, Sakai (JP); Yoshikazu Togoshi, Osaka (JP); Akira Minoura, Osaka (JP); Yoshiyuki Esaki, Sakai (JP)

(73) Assignee: Kubota Corporation, Osaka (JP)

( * ) Notice: Subject to any disclaimer, the term of this patent is extended or adjusted under 35 U.S.C. 154(b) by 528 days.

(21) Appl. No.: 12/725,012

(22) Filed: Mar. 16, 2010

(65) Prior Publication Data

US 2010/0242924 A1 Sep. 30, 2010

(30) Foreign Application Priority Data

Mar. 30, 2009 (JP) ..... 2009-082908
Mar. 30, 2009 (JP) ..... 2009-082909
Jun. 23, 2009 (JP) ..... 2009-148527

(51) Int. Cl.
*F02M 37/20* (2006.01)

(52) U.S. Cl.
USPC ..... 123/516; 123/518; 180/271; 280/756

(58) Field of Classification Search ..... 123/516, 123/518, 519, 520; 180/271, 89.12; 280/756, 280/760, 763.1; 137/587, 588, 589, 591, 137/593

See application file for complete search history.

(56) References Cited

U.S. PATENT DOCUMENTS

| | | | | | |
|---|---|---|---|---|---|
| 2,894,736 | A | * | 7/1959 | Wentworth | 261/72.1 |
| 3,244,251 | A | * | 4/1966 | Duncan | 280/756 |
| 3,515,108 | A | * | 6/1970 | Daigh et al. | 123/519 |
| 3,728,846 | A | * | 4/1973 | Nilsson | 96/134 |
| 4,727,955 | A | * | 3/1988 | Honda et al. | 180/296 |
| 4,793,839 | A | * | 12/1988 | Hayashida et al. | 96/130 |
| 5,060,620 | A | * | 10/1991 | Oslapas | 123/519 |
| 5,111,900 | A | * | 5/1992 | Leitermann | 180/69.4 |
| 5,224,455 | A | * | 7/1993 | Ogasawara | 123/519 |
| 5,427,076 | A | * | 6/1995 | Kobayashi et al. | 123/520 |
| 5,687,697 | A | * | 11/1997 | Ishikawa | 123/520 |
| 5,803,054 | A | * | 9/1998 | Yamazaki et al. | 123/519 |
| 5,855,198 | A | * | 1/1999 | Nakajima et al. | 123/520 |
| 6,105,708 | A | * | 8/2000 | Amano et al. | 180/309 |
| 7,350,511 | B1 | * | 4/2008 | Roche et al. | 123/518 |

(Continued)

FOREIGN PATENT DOCUMENTS

| | | |
|---|---|---|
| JP | 5561539 U1 | 4/1980 |
| JP | 5617723 A | 2/1981 |

(Continued)

*Primary Examiner* — Thomas Moulis
(74) *Attorney, Agent, or Firm* — The Webb Law Firm

(57) ABSTRACT

Disclosed is a fuel system for a traveling vehicle having an engine mounted on a vehicle body and a ROPS extending upward from the vehicle body. The fuel system includes a fuel tank accommodating an amount of fuel, a canister, an evaporating hose including a first evaporating hose portion and a second evaporating hose portion for sending fuel vapor generated inside the fuel tank to the canister. The first evaporating hose portion is connected to the fuel tank and extending upward from the fuel tank along a vertical post of the ROPS. The second evaporating hose portion extends downward along a vertical post of the ROPS and is connected to the canister.

11 Claims, 21 Drawing Sheets

U.S. PATENT DOCUMENTS

| | | | | |
|---|---|---|---|---|
| 7,438,058 | B2 * | 10/2008 | Ito et al. | 123/518 |
| 7,810,842 | B2 * | 10/2010 | Ichikawa | 280/782 |
| 7,976,618 | B2 * | 7/2011 | Geurtz | 96/131 |
| 2009/0013942 | A1 | 1/2009 | Yamada et al. | |
| 2009/0239706 | A1 | 9/2009 | Ishida et al. | |
| 2011/0233909 | A1 * | 9/2011 | Fukunaga et al. | 280/756 |
| 2011/0248488 | A1 * | 10/2011 | Duenchel et al. | 280/756 |

FOREIGN PATENT DOCUMENTS

| | | | |
|---|---|---|---|
| JP | 63291726 | A | 11/1988 |
| JP | 5131851 | A | 5/1993 |
| JP | 8135525 | A | 5/1996 |
| JP | 2004237953 | A | 8/2004 |
| JP | 2005178490 | A | 7/2005 |
| JP | 2006266267 | A | 10/2006 |
| JP | 2008-008238 | A | 1/2008 |
| JP | 2008184016 | A | 8/2008 |
| JP | 2008215341 | A | 9/2008 |
| JP | 2008296780 | A | 12/2008 |
| JP | 2009-067144 | A | 4/2009 |

* cited by examiner

FUEL SYSTEM FOR TRAVELING VEHICLE

BACKGROUND OF THE INVENTION

1. Field of the Invention

The present invention relates to a fuel system for a traveling vehicle having an engine mounted on a vehicle body and a rollover protection structure (ROPS) extending upward from the vehicle body.

2. Description of the Related Art

There is known a vehicle having a fuel gas recovery (collecting) apparatus including a canister incorporated in a gas passageway between a fuel tank and an engine, so that fuel gas is adsorbed by e.g. activated carbon and this adsorbed fuel gas is desorbed during driving of the engine (see e.g. JP 2008-008238 A, and JP 2009-067144 A or U.S. 2009/239706 A1 corresponding thereto).

The canister is utilized for causing fuel gas evaporated inside the fuel tank during stop of the engine (in particular, during fuel supplying operation) and the adsorbed gas is desorbed during driving of the engine and combusted, so as to restrict undesired discharge of the fuel gas (evaporated gas) evaporated inside the fuel tank into the atmosphere.

In JP 2008-008238 A, the canister is disposed upwardly of the fuel tank and connected thereto via a breather pipe. When the liquid surface inside the fuel tank is under the full (or nearly full) condition, in consideration of variation of the liquid level which occurs e.g. when the self-propelled vehicle body is inclined to the front/rear or right/left side or during acceleration, braking or turning, etc. of the vehicle (these conditions will be referred generically to as "time of vehicle body inclination" hereinafter), a portion of the gas passageway (reserve pipe) extending and communicated to the canister is disposed at a position higher than the maximum level position reachable by the liquid surface, so as to prevent liquid fuel from entering the canister.

In the case of JP 2009-067144 A (U.S. 2009/239706 A1), in a work vehicle having a ROPS (rollover protection frame), the canister is disposed immediately above the fuel tank, and the fuel tank and the canister are connected via a vapor introducing tube incorporating a two-way valve halfway thereof, so that evaporated fuel inside the fuel tank may be supplied to the canister.

In the case of JP 2008-008238 A, the canister is disposed upwardly of the fuel tank and these two are connected to each other such that a purging hose or evaporating hose may pass a position higher than the variable liquid surface level. So, even when the self-propelled vehicle body is inclined significantly, liquid fuel may not move into the canister. In this type of technique, if liquid fuel should move to the side of the canister, this will adversely affect the function of the activated carbon inside the canister.

Therefore, in the case of the work vehicle having a ROPS disclosed in JP 2009-067144 A (U.S. 2009/239706 A1) too, the canister is disposed upwardly of the fuel tank and the vapor introducing tube interconnecting the fuel tank and the canister is connected with taking partially upward detour. The reason for this arrangement is the same as that for JP 2008-008238 A (i.e. for preventing movement of liquid fuel into the canister due to vehicle inclination).

It is sometimes desirable to dispose the canister not immediately upwardly of the fuel tank, but distant therefrom. Also, the fuel tank may be elongate in the front/rear direction or has a large width. Or, a pair of fuel tanks may be disposed in distribution on the right/left sides. In such cases, the canister is sometimes disposed at positions not upwardly of the fuel tank. In these cases, the variable liquid surface level will become higher with inclination of the self-propelled vehicle body. Therefore, in such cases, it becomes necessary to provide separately a support member for raising the evaporating hose to an even higher position or make some arrangement for preventing the elevation of the variable liquid surface level between the fuel tank and the canister.

In view of the above, the object of the present invention is to prevent inadvertent entrance of fuel liquid in the fuel tank to the side of the canister, even in the event of significant inclination of the self-propelled vehicle body.

SUMMARY OF THE INVENTION

For accomplishing the above object, the present invention provides the following characterizing features.

A fuel system for a traveling vehicle having an engine mounted on a vehicle body and a ROPS extending upward from the vehicle body, the fuel system comprising:

a fuel tank accommodating an amount of fuel;

a canister;

an evaporating hose including a first evaporating hose portion and a second evaporating hose portion for sending fuel vapor generated inside the fuel tank to the canister;

said first evaporating hose portion being connected to the fuel tank and extending upward from the fuel tank along a vertical post of the ROPS; and said second evaporating hose portion extending downward along a vertical post of the ROPS and being connected to the canister.

With the above-described construction, when the engine is operated, fuel gas adsorbed to the canister is desorbed to be drawn into the engine. While the engine is stopped, the fuel gas evaporated inside the fuel tank is guided to the canister and collected by the adsorption. When fuel is to be supplied to the fuel tank, the fuel gas evaporated in the fuel tank is guided to the canister and collected.

In the course of the above, since the first evaporating hose portion extends upward from the fuel tank along the vertical post of the ROPS, in the case of front/rear or right/left inclination of the self-propelled vehicle body or at the time of acceleration, braking or turning (the time of vehicle body inclination), even if there occurs significant front/rear or right/left inclination of the vehicle body thereby to result in significant change in the liquid surface level, there occurs no movement of the liquid fuel to the canister. Therefore, since the intrusion of liquid fuel inside the fuel tank to the canister is prevented, there occurs no deterioration or destruction of the function/performance of the canister.

Further, since the first and second evaporating hose portions are extended along the vertical post of the ROPS, by using the ROPS frame provided originally in the work vehicle as the support member therefor, there is no need to provide any support members separately that are dedicated to supporting such evaporating hoses. Or, even if such a support member dedicated to supporting the evaporating hoses is to be provided, this support member can be small and compact.

According to one preferred embodiment of the present invention, the first and second evaporating hose portions are disposed along the inner face of the vertical post.

According to a further preferred embodiment, a separator tank for separating fuel from fuel vapor is attached to the ROPS and is connected to the first evaporating hose portion and the second evaporating hose portion. In this case, advantageously, the vertical post comprises an upper/lower two-divided hinge-foldable construction, with the separator tank being attached to the portion downwardly of the hinge. Further, a housing of the separator tank may comprise a mounting bracket for mounting the separator tank to the ROPS. Further, a wave-preventing float may be provided on a liquid surface in the separator tank.

According to a still further preferred embodiment, a seat is disposed forwardly of the ROPS and the canister is disposed between the seat and the engine.

In the above, the canister can be disposed in a space where cooling air generated by an engine cooling fan is caused to flow. Further, this canister may be disposed in opposition to an outer periphery of a rear wheel and along an outer peripheral region of the rear wheel. In this case, advantageously, the fuel tank too may be disposed in opposition to the outer periphery of the rear wheel and along the outer peripheral region of the rear wheel, the fuel tank being disposed adjacent the canister.

Further and other features and advantages resulting therefrom will become apparent upon reading the following detailed disclosure of the invention with reference to the accompanying drawings.

BRIEF DESCRIPTION OF THE DRAWINGS

FIGS. 1-19 show a first embodiment of the present invention, in which,

FIG. 1 is an overall side view of a riding type grass mower,

FIG. 2 is an overall plan view of the riding type grass mower,

FIG. 3 is a side view of principal portions of the inside and an ambient air introducing portion of an engine room, FIG. 4 is a plan view in horizontal section showing the principal portions of the ambient air introducing portion, FIG. 5 is a front view in vertical section showing layout of a canister and an oil cooler, FIG. 6 is a side view of principal portions showing layout of a fuel tank and an evaporated gas separator tank, FIG. 7 is a front view of principal portions showing layout of the canister and a cooling tube of the oil cooler, FIG. 8 shows a cover construction of the evaporated gas separator tank, (a) being a front view in vertical section, (b) being a side view, (c) being a plan view, FIG. 9 is a side view in vertical section of the evaporated gas separator tank, FIG. 10 is a side view in vertical section of principal portions showing a condition when an amount of liquid fuel has entered the evaporated gas separator tank, FIG. 11 is a block diagram showing a flow of the fuel, FIG. 12 is a rear view showing a condition when a spark arrester is attached to an exhaust pipe of a muffler, FIG. 13 is a rear view showing a condition when the spark arrester is detached, FIG. 14 is a side view of principal portions showing layout of a fuel tank, an evaporated gas separator tank and a two-way valve in an alternative embodiment of the first embodiment, FIG. 15 is a system diagram illustrating function of the two-way valve in the alternate embodiment of the first embodiment, FIG. 16 is a rear view of principal portions showing layout of an evaporated gas separator tank and a two-way valve in a further alternate embodiment of the first embodiment, FIG. 17 is a side view of principal portions showing layout of a fuel tank, an evaporated gas separator tank and a two-way valve in the further alternate embodiment of the first embodiment, FIG. 18 is a rear view showing layout of a canister in a still further alternate embodiment of the first embodiment, and FIG. 19 is a side view showing layout of a canister in the still further embodiment of the first embodiment, FIGS. 20-25 show a second embodiment of the present invention, in which, FIG. 20 is a side view of principal portions of the inside and an ambient air introducing portion of an engine room, FIG. 21 is a plan view of principal portions of the ambient air introducing portion, showing layout of a canister, FIG. 22 is a front view in vertical section showing layout of the canister and an evaporating hose arranged along the ROPS frame, FIG. 23 is a side view of principal portions showing layout of an evaporating hose to be connected to a fuel tank, FIG. 24 is a block diagram showing flow paths of fuel and evaporated gas, and FIG. 25 is a function diagram of a two-way valve.

DETAILED DESCRIPTION OF THE PREFERRED EMBODIMENTS

[First Embodiment]

Figure 1:
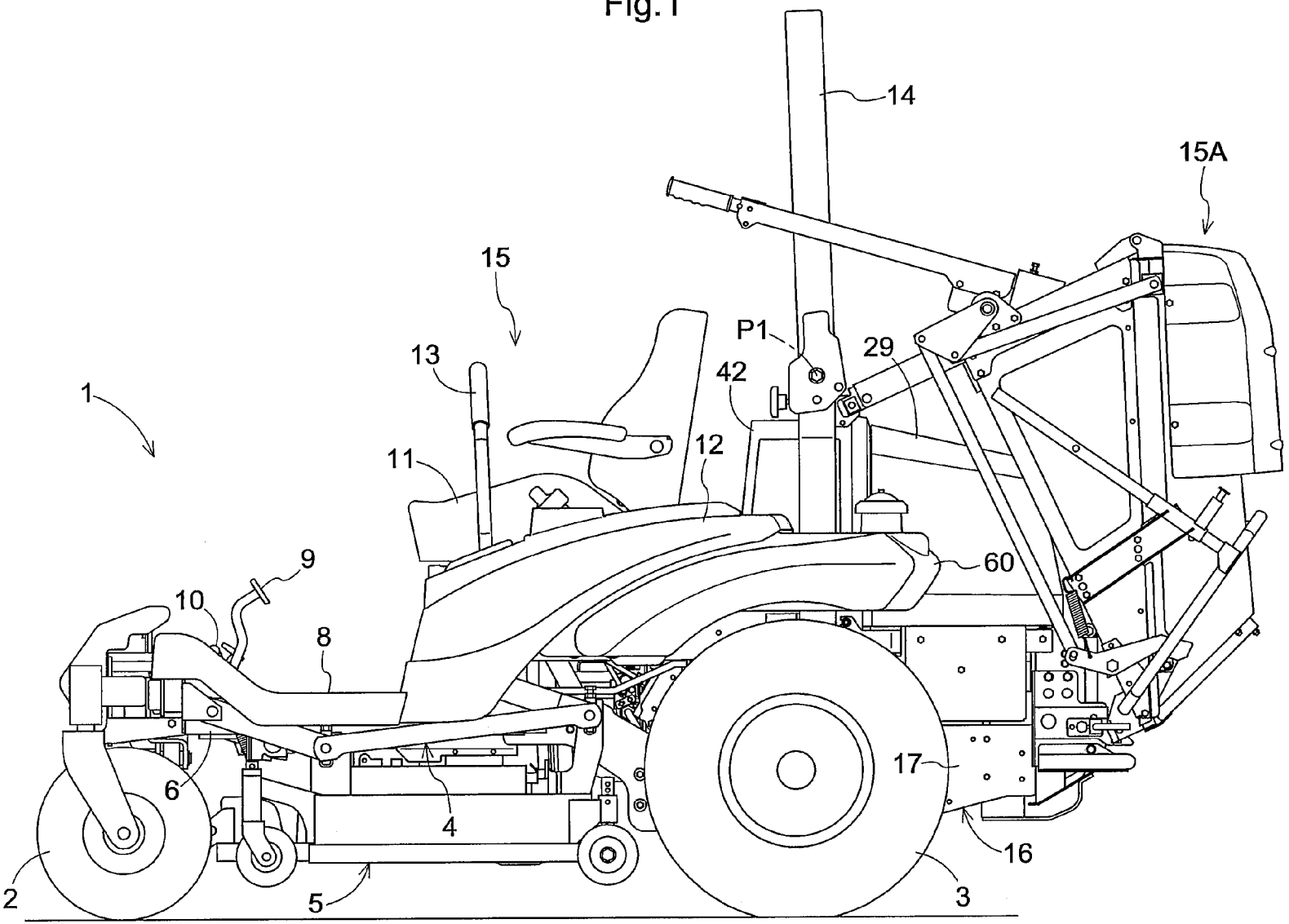
Figure 2:
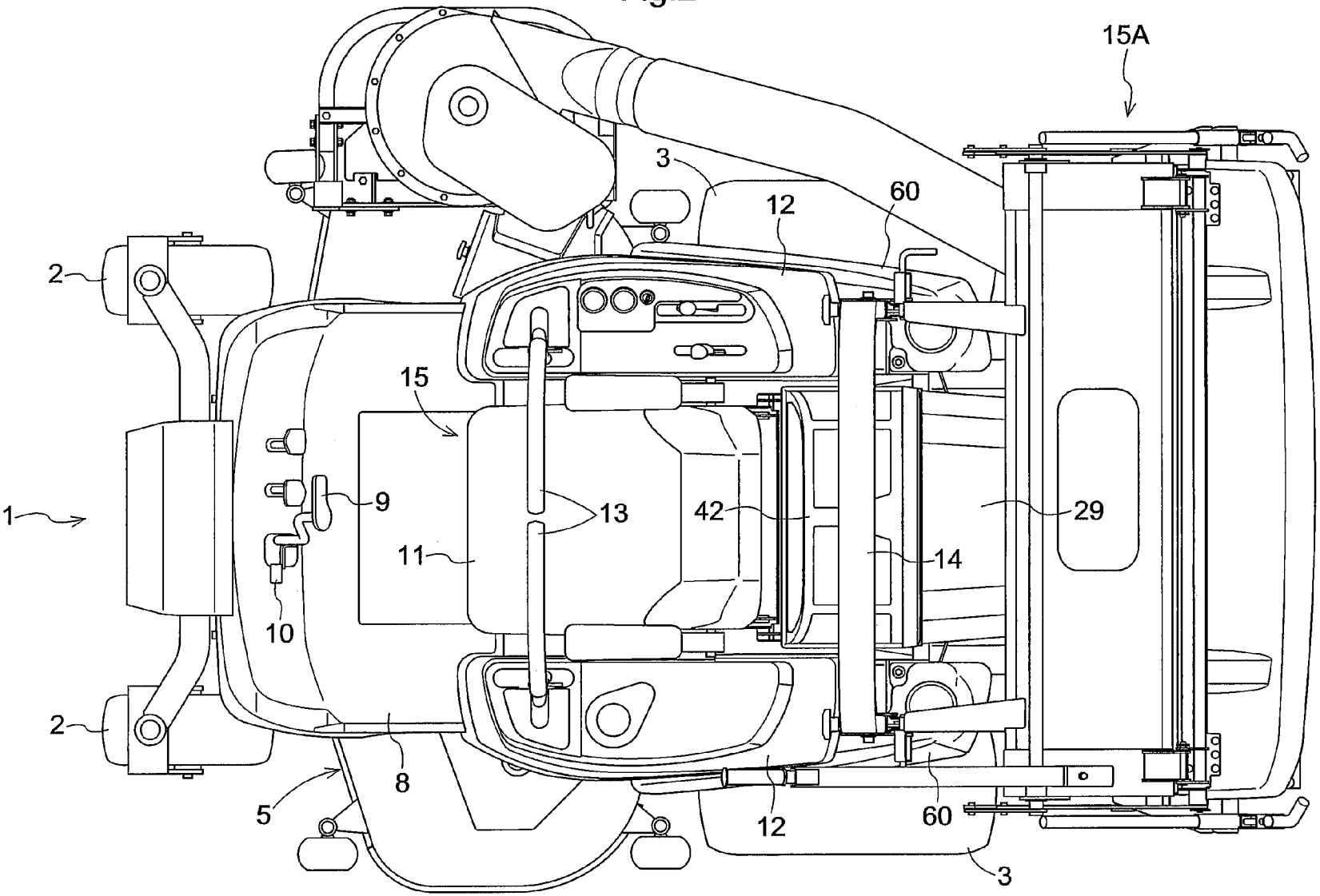

First, with reference to FIGS. 1-19, a first embodiment will be described. The embodiment shown is applied to a riding type grass mower as an example of a work vehicle. FIG. 1 is an overall side view of the riding type grass mower, and FIG. 2 is an overall plan view of the same. As shown in FIGS. 1 and 2, the riding type grass mower illustrated in this embodiment is constructed as a "mid-mount type" wherein a mower 5 is disposed to be lifted up/down via a link mechanism 4 between a pair of right/left front wheels 2 and a pair of right/left rear wheels 3 mounted on a traveling vehicle body 1.

The traveling vehicle body 1 includes, on its front side, a front frame 6 formed of angular pipes or the like. This front frame 6 supports the link mechanism 4 and to the right/left ends at its front end portion, the right/left front wheels 2 are mounted to be steerable about vertical axes. The link mechanism 4 is configured to lift up/down the mower 5 in parallel therewith, in association with an operation of an unillustrated hydraulic cylinder.

To the front frame 6, there is attached a driver's access step 8 made of plate metal and covering the front frame 6 substantially entirely from above. On the surface of this access step 8, a rubber mat (not shown) is placed and at a front center portion of the step 8, there are disposed a brake pedal 9 which is urged to return to the non-braking position and a lock pedal 10 capable of retaining the brake pedal 9 at its braking position against the urging force. Rearwardly and upwardly of the access step 8, there is provided a driver's seat 11 which is position-adjustable. On the right/left sides of the driver's seat 11, fenders 12 and speed-changing levers 13 are disposed respectively. Rearwardly of the driver's seat 11, there is disposed erect an arch-shaped ROPS frame 14. Thus, in this riding type grass mower, a riding driver's section 15 is formed on the front side of the traveling vehicle body 1.

The main body of the ROPS frame 14 is formed of hollow angular pipe members, and the ROPS frame 14 is switchable in its posture between an erect posture (see FIG. 1 and FIG. 5) where the frame is erect about a horizontal axis P1 and a rearward collapsed posture where the frame is collapsed rearward to ride over the top surface of a grass collecting portion 15A.

As shown in FIGS. 1-4, at a rear portion of the traveling vehicle body 1, there is disposed a rear frame 16 connected to the rear end of the front frame 6. The rear frame 16 includes such members as a pair of right/left side members 17 formed of plate metal, a mounting deck 18 supported to the rear ends of the right/left side members 17. The mounting deck 18 mounts an air-cooled type gasoline engine 19, with its output shaft 20 projecting to the front side of the vehicle body.

Forwardly and downwardly of the engine 19, there is mounted a transmission apparatus (an example of speed changing apparatus) 21 configured to speed-reduce the power from the engine 19 and to separate it into power for traveling and power for utility work. Inside the transmission apparatus 21, there is mounted a clutch (not shown) for connecting/breaking transmission of the power for utility work. On the right/left opposed sides of the transmission apparatus 21, hydrostatic stepless speed changing apparatuses (an example of speed changing apparatus, to be referred to as "HST" hereinafter) 22 for receiving traveling power from the transmission apparatus 21 are connected respectively. To the lateral outer side of each HST 22, there is connected a speed reducing apparatus 23 receiving the speed-changed power of the HST 22 corresponding thereto. To each speed changing apparatus 23, a rear wheel 3 corresponding thereto is mounted. Each HST 22 is operably coupled to a speed changing lever 13 corresponding to its speed changing operating shaft (not shown), so that the HST 22 is speed-changed by a pivotal operation of the speed changing lever 13 in the front/rear direction.

With the above-described construction in operation, as the right/left speed changing lever 13 is pivotally operated in the front/rear direction, the HST 22 corresponding to each operating lever 13 may be speed-changed and the right/left rear wheels 3 can be speed-changed and driven independently of each other.

That is to say, with this riding type grass mower, the right/left front wheels 2 are mounted to be steerable and the right/left rear wheels 3 can be speed-changed and driven independently of each other. Whereby, there can be realized as desired, a stopped condition where the right/left rear wheels 3 are stopped, a straight traveling condition where the right/left rear wheels 3 are driven at an equal speed and driven forwardly or in reverse, a grand turning condition where the right/left rear wheels 3 are driven at different speeds forwardly or in reverse, a pivot turning condition where one of the right/left rear wheels 3 is stopped while the other of the same is driven forwardly or in reverse, and a spin turning condition where one of the right/left rear wheels 3 is driven forwardly and the other is driven in reverse.

Forwardly and downwardly of the transmission apparatus 21, there is mounted a PTO shaft 24 for allowing takeoff of power for utility work to the mower 5. The PTO shaft 24 transmits the utility work power from the transmission apparatus 21 to the mower 5 via an expandable/retractable shaft (not shown) or a universal joint (not shown). That is, to the mower 5, there is transmitted a fixed speed power, regardless of the traveling speed or traveling condition.

At the rear end of the rear frame 16, there is provided a rear cover 27 configured to include right/left side walls 27A and a rear wall 27B. The rear wall 27B of the rear cover 27 defines a plurality of vent holes 28. To the rear cover 27, an upper cover 29 for covering the engine 19 from above is pivotally connected to be pivotally opened/closed about the upper end of the cover 27. The upper cover 29 includes a rear wall 29A which defines a plurality of vent holes 30. To the side member 17 of the rear frame 16, there is attached erect a partitioning wall 32 which forms an engine room 31 together with the rear cover 27 and the upper cover 29. Rearwardly of the engine 19, there is disposed a muffler 33.

The muffler 33 has a substantially cylindrical outer shape disposed on the right and left. An exhaust pipe 57 is attached to a lower side of the muffler 33 with an offset to the left side, the exhaust pipe 57 having an L-like rear shape and extending toward the other end of the muffler 33. At the rear end of the exhaust pipe 57, there is disposed a large-diameter exhaust pipe 58 for reducing the temperature of exhaust gas, the exhaust pipe 58 having a greater diameter than the exhaust pipe 57 and being bent rearward. The large-diameter exhaust pipe 58 is inserted to a right-hand raised terminal end of the exhaust pipe 57 and has its upper end bolt-fixed to the muffler 33 and has its lower end bolt-fixed to a stay 59 attached to the engine 19. The large-diameter exhaust pipe 58 is provided for allowing introduction of air between this pipe 58 and the exhaust pipe 57, thereby to reducing the temperature of the exhaust gas and also reducing the exhaust noise.

At the rear end of the exhaust pipe 57, a spark arrester 77 is fixed. This spark arrester 77 is provided for preventing discharge of fire spark from the exhaust pipe 57. An outer tubular portion 78 of the spark arrester 77 is screw-fixed to the rear end of the exhaust pipe 57. The spark arrester 77 includes a conical mesh-like portion 79 and the leading end of this mesh-like portion 79 is inserted into the exhaust pipe 57 so that fire spark may come into contact with this to be extinguished. The spark arrester 77 can be dismounted by removing the attaching bolt of the large-diameter exhaust pipe 58 to detach this large-diameter exhaust pipe 58 and then remove the attaching screw of the spark arrester 77. So, attachment and detachment of this spark arrester 77 can be carried out easily and the maintenance operations thereof such as cleaning too can be carried out easily.

Figure 3:
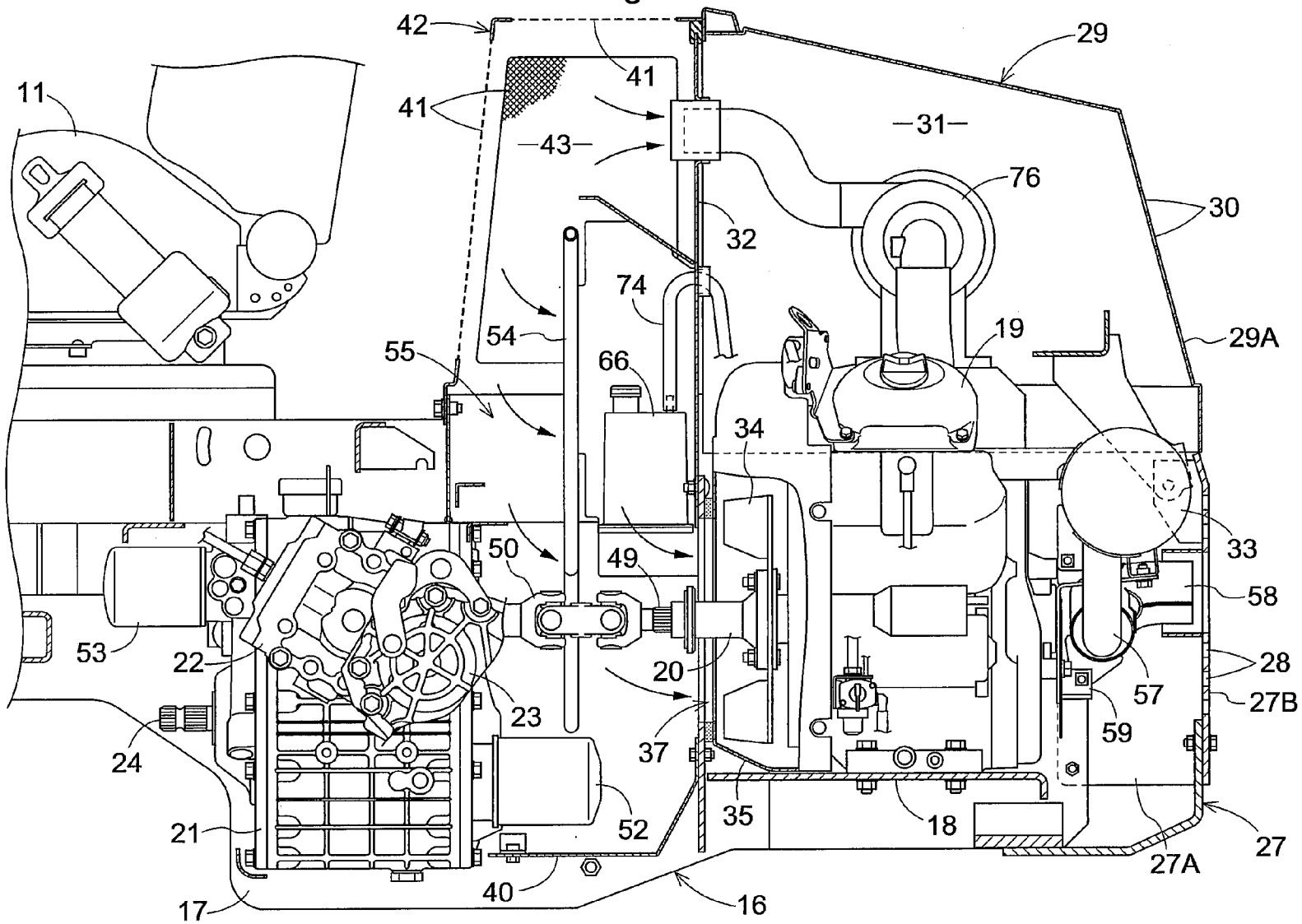
Figure 4:
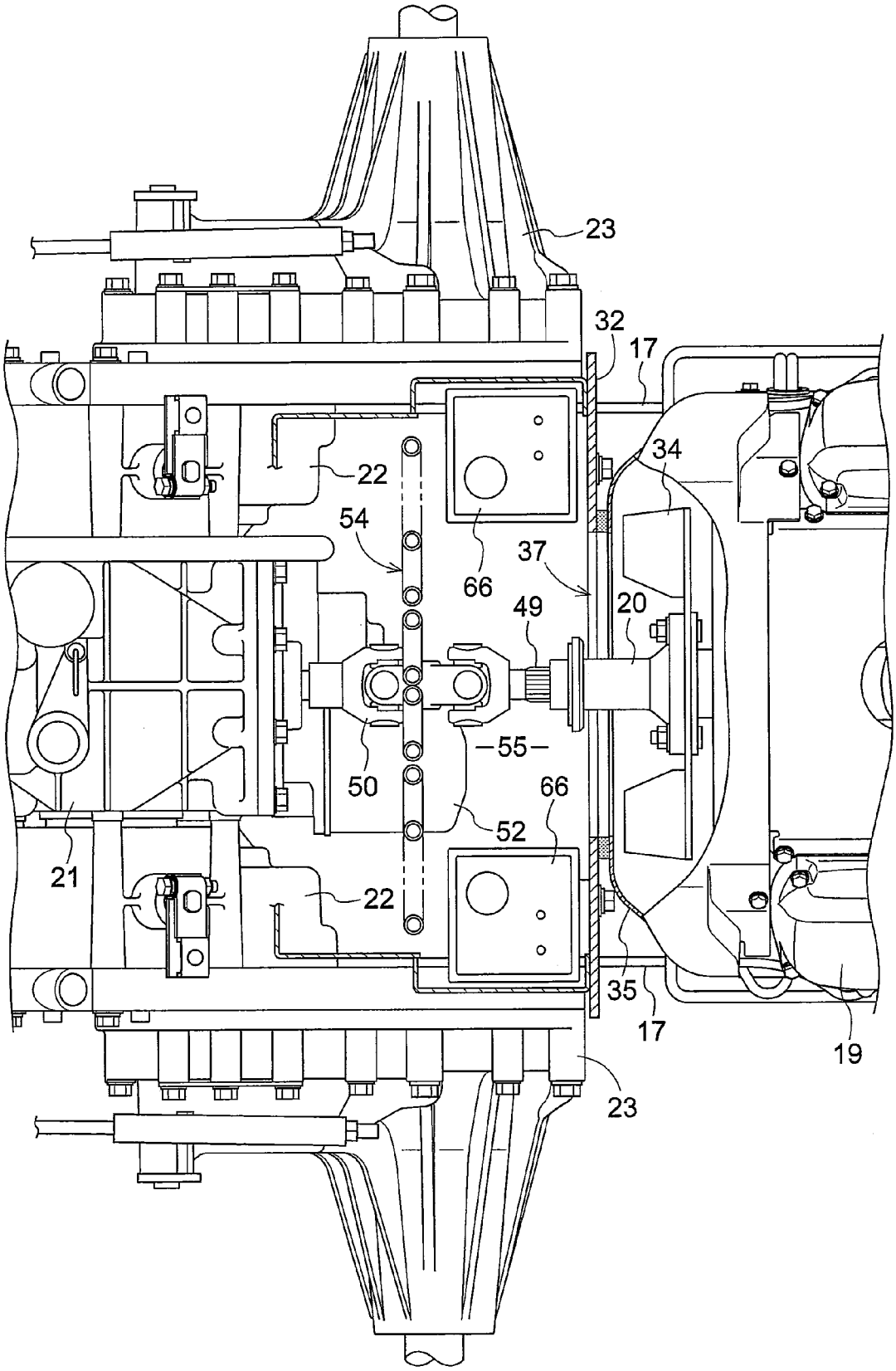

As shown in FIG. 3 and FIG. 4, at the front portion of the engine 19, there are mounted an engine cooling fan 34 rotatable in unison with the output shaft 20 of the engine 19 and an air guiding housing 35 covering the engine cooling fan 34 from front. The engine cooling fan 34 is configured to draw in, with its rotation, ambient air to the inside of the air guiding housing 35 via an air introducing opening 37 formed in the front face of the air guiding housing 35 and having a circular front shape, and then to cause this introduced air to flow as cooling air toward the engine 19. The air guiding housing 35 guides this cooling air from the engine cooling fan 34 to the periphery of the engine 19, thus cooling this engine 19 and the muffler 33. The cooling air which has cooled the engine 19 and the muffler 33 is discharged to the outside of the vehicle through the respective vent holes 28 of the rear cover 27 and the respective vent holes 30 of the upper cover 29.

Between the right/left side members 17, there is supported a dustproof plate 40 that closes from below the space that is formed on the rear side of the transmission apparatus 21 and the right/left HST's 22 and on the front side of the engine cooling fan 34 and the mounting deck 18.

As shown in FIG. 1 and FIG. 3, between the partitioning wall 32 at the front end of the upper cover 29 and the driver's seat 11, there is integrally provided a dustproof cover 42 having a dustproof mesh 41 for removing dust. The partitioning wall 32 and the dustproof cover 42 together form an ambient air introducing space 43, and from this ambient air introducing space 43, clean ambient air can be supplied to an air cleaner 76 of the engine 19 and the air introducing opening 37 of the air guiding housing 35.

As shown in FIG. 3 and FIG. 4, power transmission from the engine 19 to the transmission apparatus 21 is effected via a transmission shaft 49 splined on the output shaft 20 to be slidable relative thereto and a pair of front/rear universal joints 50.

Rearwardly and downwardly of the transmission apparatus 21, there are mounted a hydraulic pump for drawing in oil reserved inside the transmission apparatus 21 and pressure-feeding this oil and a cartridge type first oil filter 52 for filtering the oil drawn in by the hydraulic pump. Forwardly and upwardly of the transmission apparatus 21, there is mounted a second oil filter 53 for filtering the oil to be supplied to the right/left HST's. 22.

Between the partitioning wall 32 and the transmission apparatus 21, there is mounted an oil cooler 54 for cooling the oil supplied in circulation to the transmission apparatus 21, the hydraulic cylinder (not shown), the right/left HST's 22 and a hydraulic clutch (not shown). The oil cooler 54 is disposed in a cooling air passageway 55 extending from the ambient air introducing space 43 to the engine 19 and the transmission apparatus 21 disposed downwardly thereof. A cooling pipe 56 constituting the oil cooler 54 is bent and folded in hairpin-like manner to the right/left and upper and lower directions, and its lower side stride across the universal joint 50, so that a greater portion thereof may be overlapped with the engine cooling fan 34 as seen in the front/rear direction. With the above-described arrangement, the oil cooler 54 can be readily cooled by the engine cooling air flowing in the ambient air introducing space 43 and the cooling air passageway 55 of the oil cooler 54. The lower portion of the oil cooler 54 draws in air present forwardly thereof and this cooling air together with the cooling air flowing in the ambient air introducing space 43 is introduced to the air introducing opening 37 of the air guiding housing 35 and supplied to the engine 19.

Downwardly and rearwardly of the right/left fenders 12, 12 and at positions upwardly of the right/left rear wheels 3, 3, there are disposed fuel tanks 60, 60 for holding gasoline therein. The right/left fuel tanks 60, 60 are shaped so as to circumvent the ROPS frame 14, and are elongate in the front/rear direction and the left fuel tank 60 has a greater capacity than the right fuel tank 60. At two, front/rear positions apart from each other at front/rear ends of an upper face each of the right/left fuel tanks 60, there are attached connecting members 68 for a hose 73 each acting as a connecting port.

Figure 11:
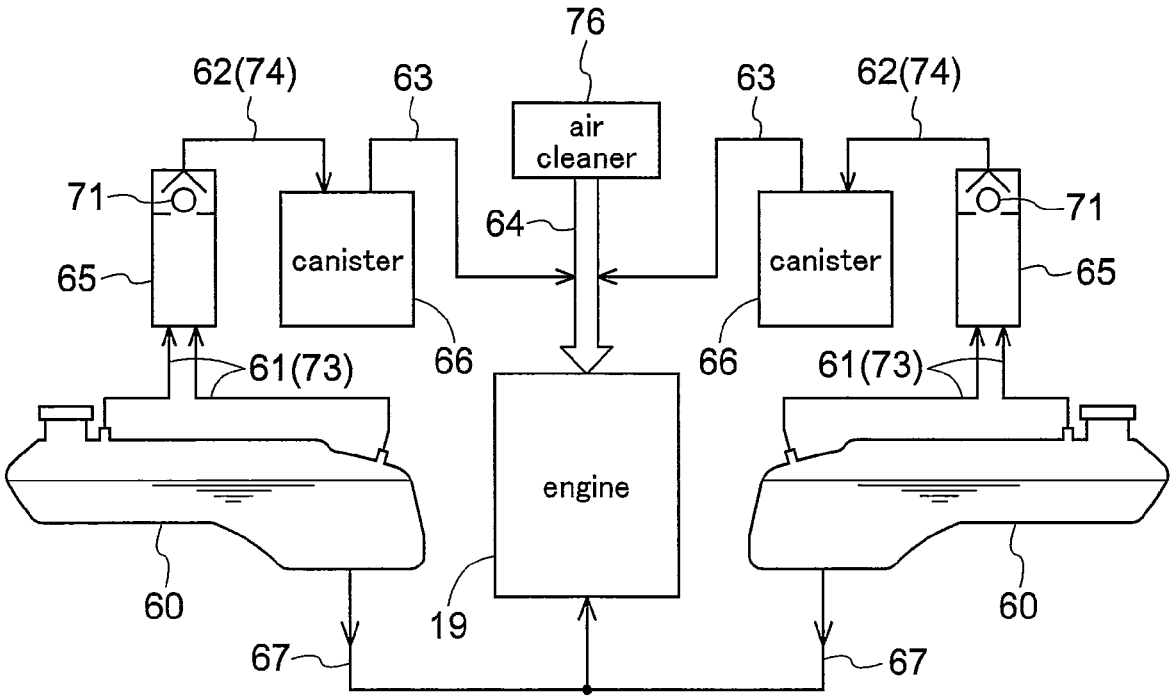
Figure 12:
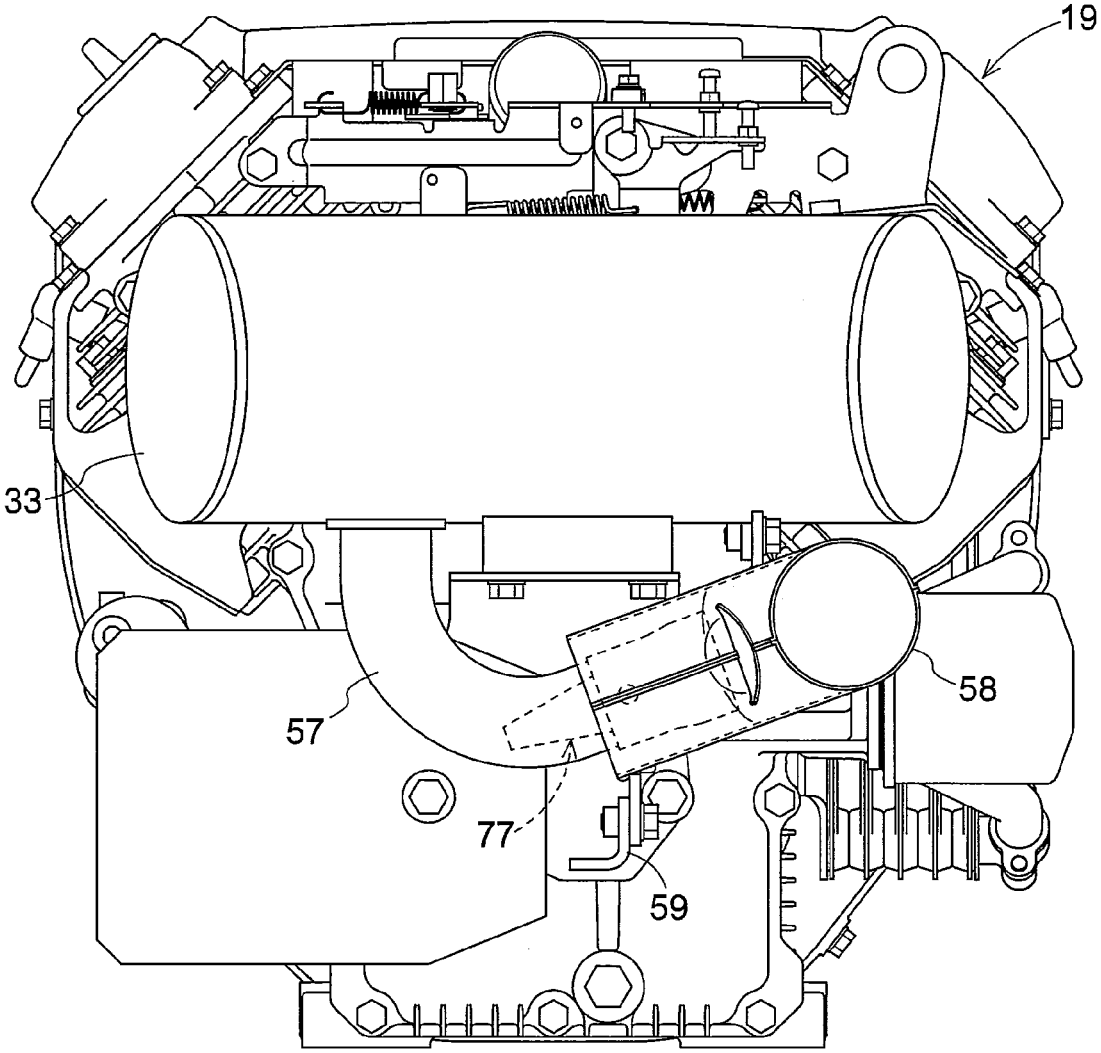
Figure 13:
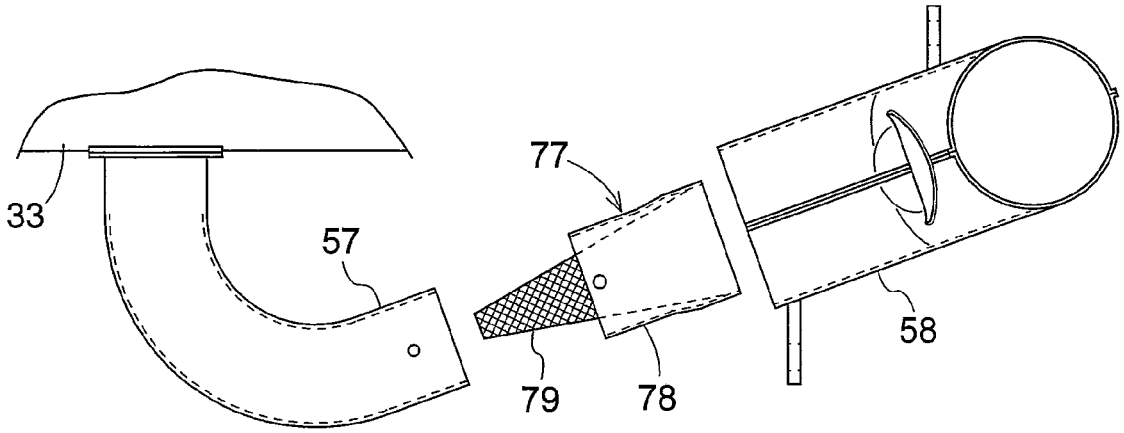

The gasoline inside the fuel tank 60 is partially evaporated inside this tank 60. This evaporated gas (fuel gas) is drawn in during an air intake stroke of the engine 19 to be combusted. FIG. 11 is a block diagram for explaining the flows of the ambient air and evaporated gas in the fuel supplying line. In gas passageways 61, 62, 63, 64 between the fuel tanks 60 and the engine 19, there are incorporated evaporated gas separator tanks (example of a separator tank) 65 and canisters 66. Evaporated gas (evaporated fuel gas) generated inside the fuel tank 60 flows through the evaporated gas separator tank 65 and is adsorbed in the canister 66, and fuel gas which has been desorbed in the intake stroke of the engine 19 is supplied, together with the air, to the cylinder of the engine 19 (this will be referred to simply as the "engine 19"). Liquid fuel (gasoline) is supplied from the fuel tank 60 trough a fuel passageway 67 to the engine 19.

The evaporated gas separator tank 65 is provided for recovering fuel gas which has been evaporated inside the fuel tank 60 and sending this to the canister 66, and this tank 65 is incorporated between the gas passageways 61, 62 extending between the fuel tank 60 and the canister 66. The evaporated gas separator tank 65 is disposed at a position upwardly of the fuel tank 60. More particularly, a cover 69 extends from the front/rear face to the inner side of the ROPS frame 14 so as to surround the evaporated gas separator tank 65. And, a bent piece 69*a* of the cover 69 extending in the space surrounded by this cover 69 and the ROPS frame 14 is connected by bolts 83 with an attaching piece 65*a* formed at an upper portion of the evaporated gas separator tank 65, whereby the evaporated gas separator tank 65 is attached to the cover 69.

Figure 8:
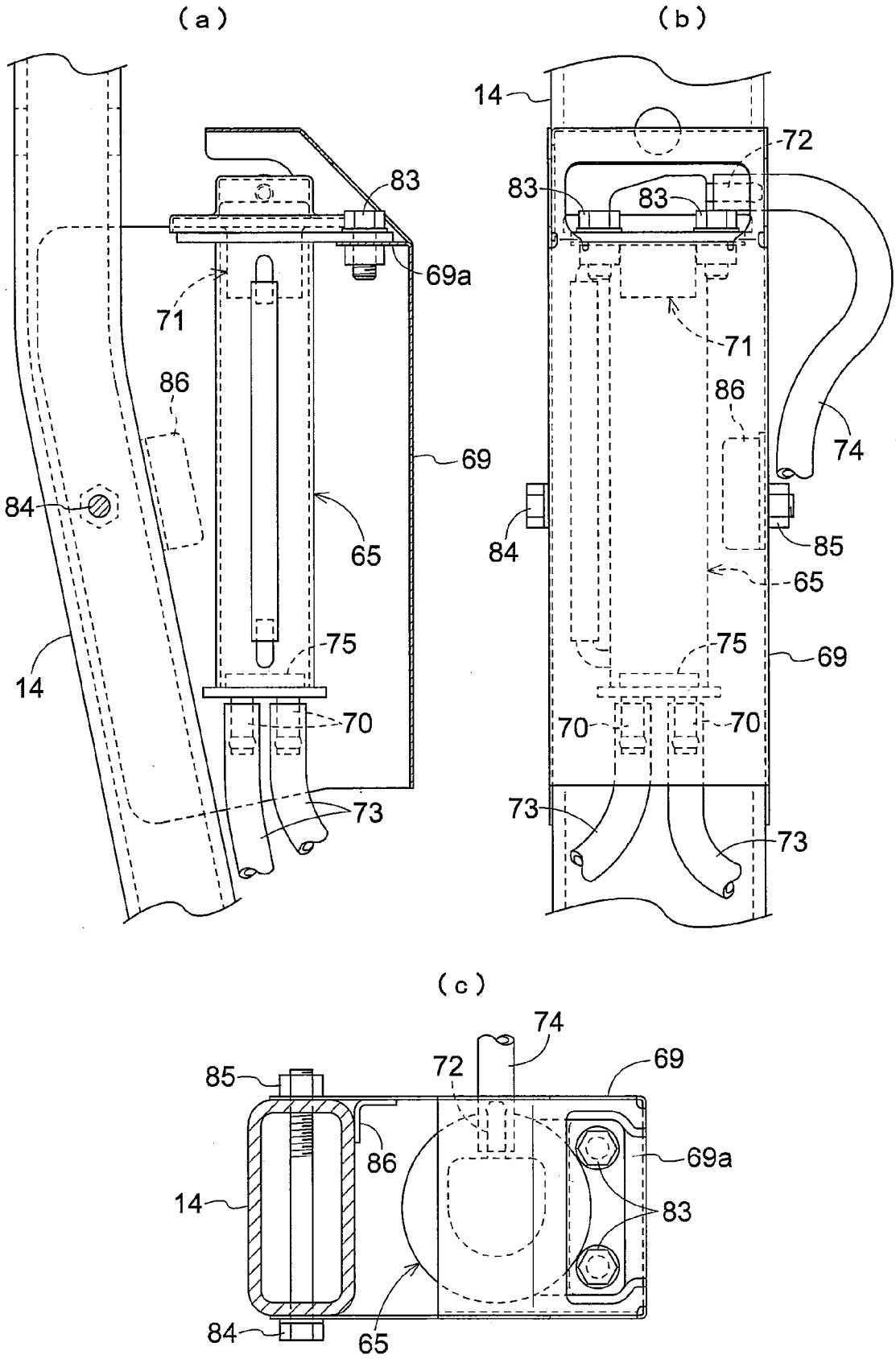
Figure 9:
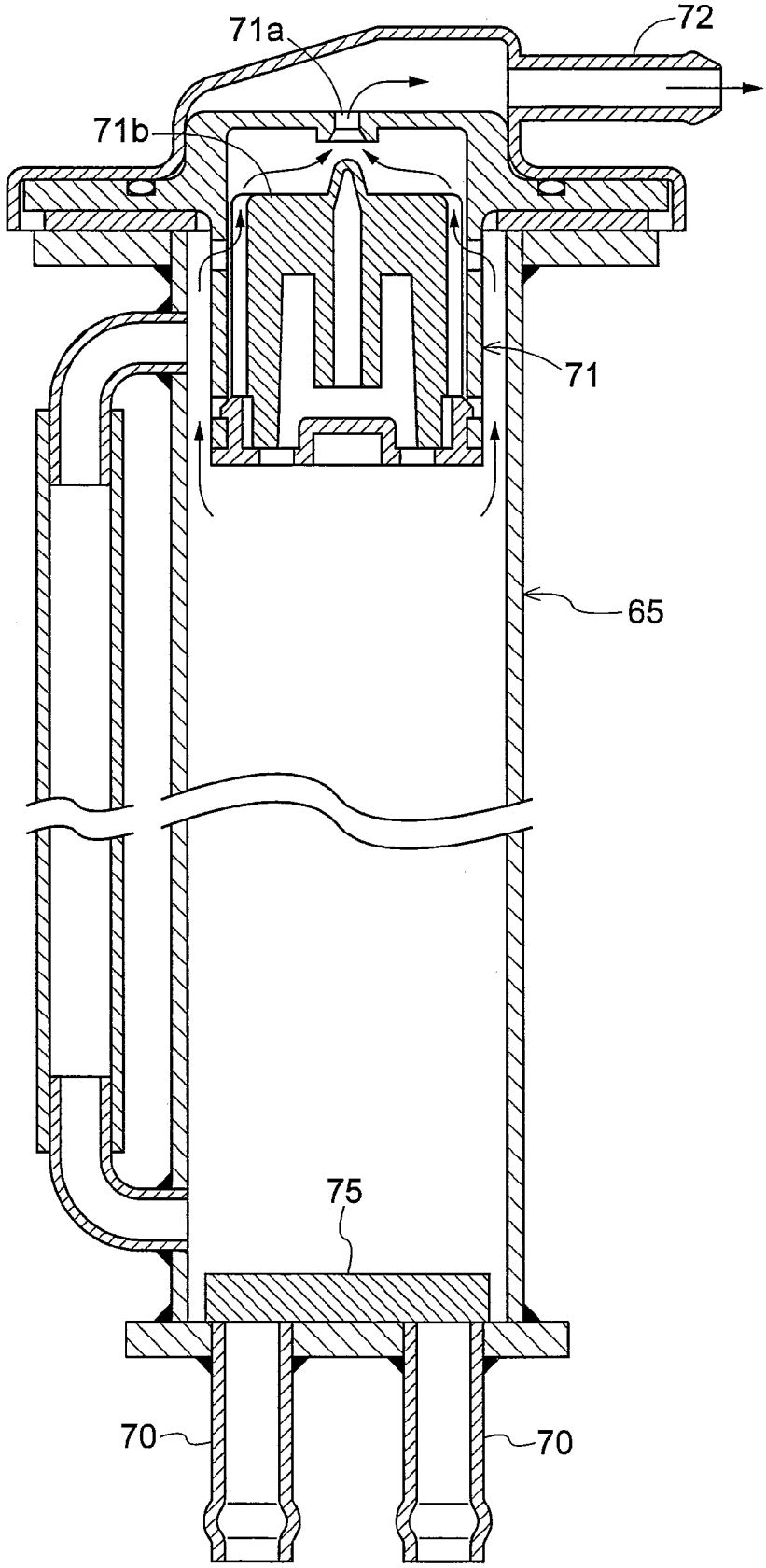
Figure 10:
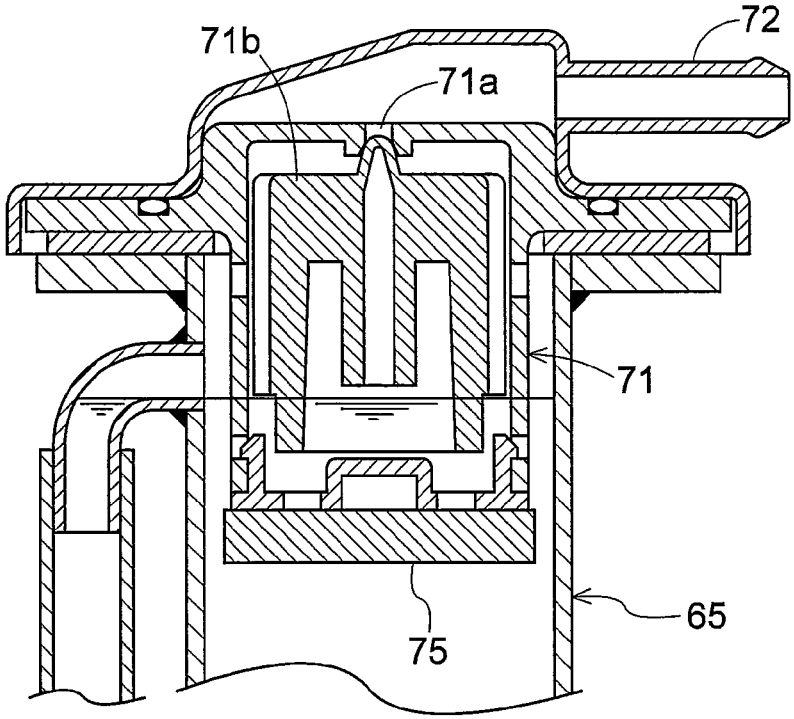

As shown in FIG. 8, at a right/left intermediate portion of the ROPS frame 14, bolt holes extend through the frame 14 in the front/rear direction. And, in front/rear side plates of the cover 69, bolt holes extend in registry with the bolt holes in the ROPS frame 14. And, to the rear side plate of the cover 69, there is fixed a positioning bracket 86 for contacting the inner face of the ROPS frame 14 to the rear plate of the cover 69, thus positioning these. With the bolt holes on the ROPS frame 14 side and the bolt holes of the front/rear plates of the cover 69 being in registry with each other, a bolt 84 is inserted into these holes and fastened with a nut 85. That is, the cover 69 functions also as an attaching member for attaching the evaporated gas separator tank 65 to the ROPS frame 14.

To the lower end of the evaporated gas separator tank 65, there are two hose connecting members 70, 70 acting as intake ports to be connected to the two hose connecting members 68 attached to the front/rear portions of the upper face of the fuel tank 60. As the two purging hose connecting members 68 are provided in the fuel tank 60, accumulation of air hardly occurs, and the system can be constructed without limitations to the shape and posture of the tanks.

Inside the evaporated gas separator tank 65, a liquid surface level stationary float 75 is accommodated. This liquid surface level stationary float 75 has a circular shape in its plan view and has many concave and convex portions (not shown) in its upper and lower faces. Normally, the inside of the evaporated gas separator tank 65 is filled with air (ambient air) or fuel gas and when the fuel gas inside the fuel tank 65 is sent to the side of the canister 66, this fuel gas passes through the spaces formed by the concave and convex portions formed in the faces of the liquid surface level stationary float 75. The float 75 functions to restrict occurrence of rocking of the liquid surface when an amount of gasoline has entered due to e.g. inclination of the vehicle body.

At an upper portion of the evaporated gas separator tank 65, there is accommodated a shutoff valve comprising a float valve 71. This float valve 71 is pushed up to close a discharge port 71*a* by the liquid surface level stationary float 75 when the gasoline (liquid fuel) has filled in the interior of the evaporated gas separator tank 65 with intrusion of gasoline into the evaporated gas separator tank 65, thus preventing entrance of the liquid fuel into the canister 66. A connecting member 72 is provided as a connector port to be connected to the canister 66 continuous with the discharge port 71*a* via a hose 74. The right/left hoses 74 for connecting the right/left evaporated gas separator tanks 65 with the right/left canisters 66 have a same inner diameter and substantially same hose lengths. The discharge port 71*a* is normally opened, and this port 71*a* is closed with elevation of the float 71*b* when the interior of the evaporated gas separator tank 75 is filled with gasoline (liquid fuel).

If the evaporated gas separator tanks 65 were not provided, it would be needed to provide connector hoses having a larger diameter so as to be capable of coping with sudden outflow of fuel gas from the fuel tanks 60. In this embodiment, as the evaporated gas separator tanks 65 are provided in the gas passageways 61, 62 extending between the fuel tanks 60 and the canisters 66, so as to temporarily collect fuel gas generated in the fuel tanks 60. Thus, the diameter of the hoses can be small, so the assembly is facilitated. Further, as there is no need to reserve fuel gas in the evaporating hoses, the hose length can be short, so that the costs can be reduced.

As the evaporated gas separator tank 65 is disposed to communicate with the fuel tank 60, when the interior of the fuel tank 60 is full with gasoline, if an amount of gasoline overflows from the fuel tank due to e.g. its thermal expansion, the space provided inside the evaporated gas separator tank 65 can absorb this amount of overflown gasoline, thus effectively preventing leak of gasoline to the outside of the tank.

Figure 5:
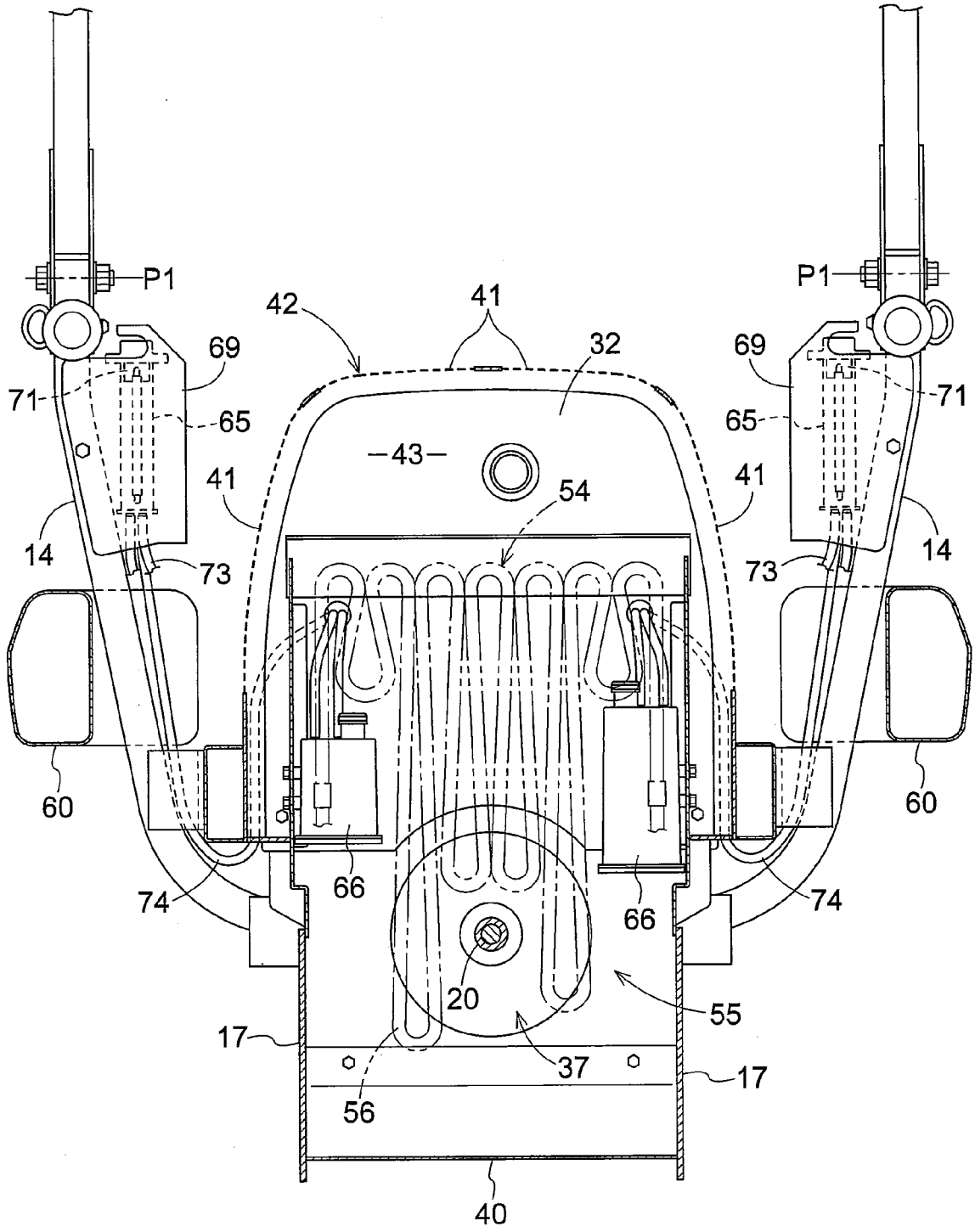
Figure 6:
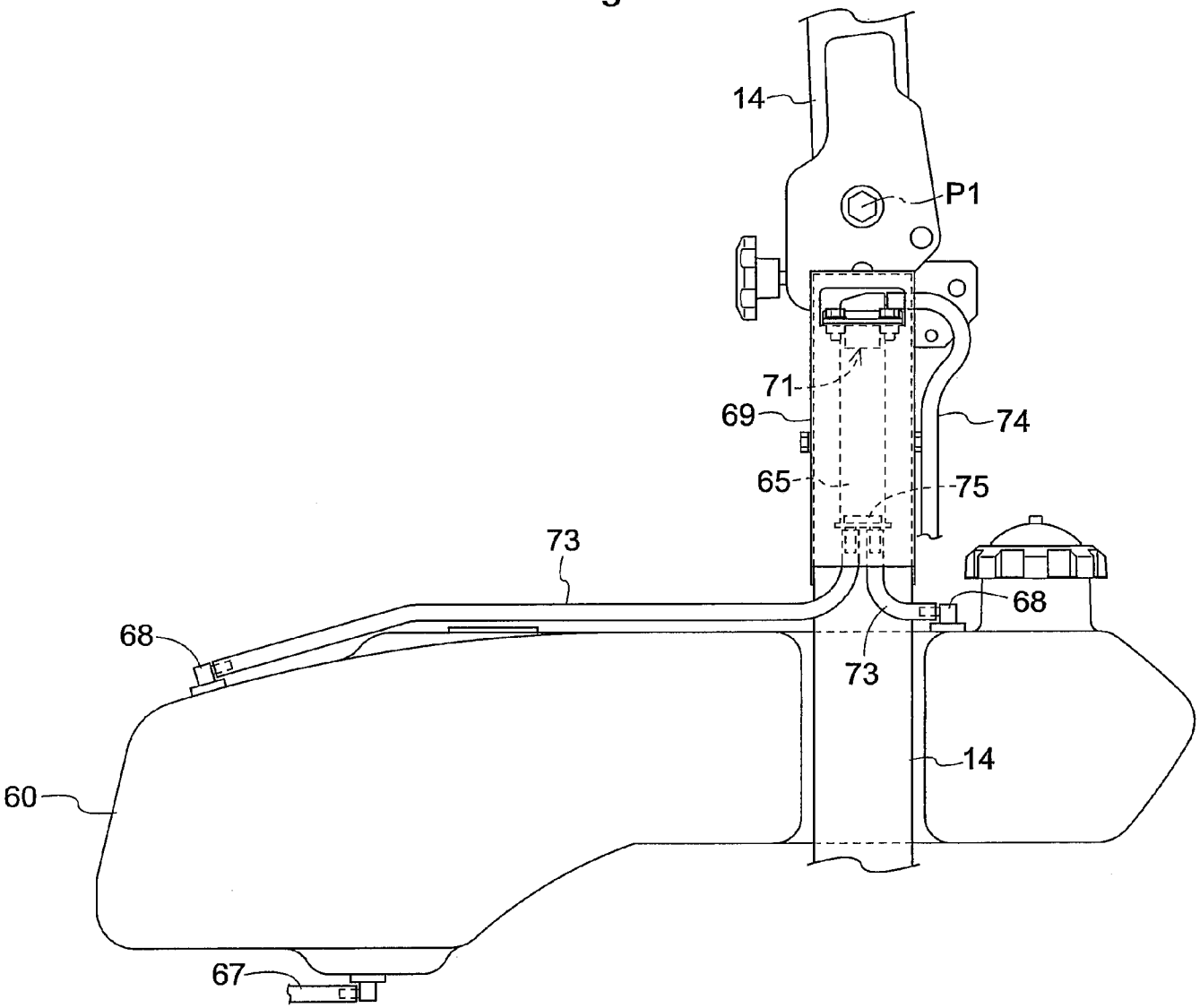
Figure 7:
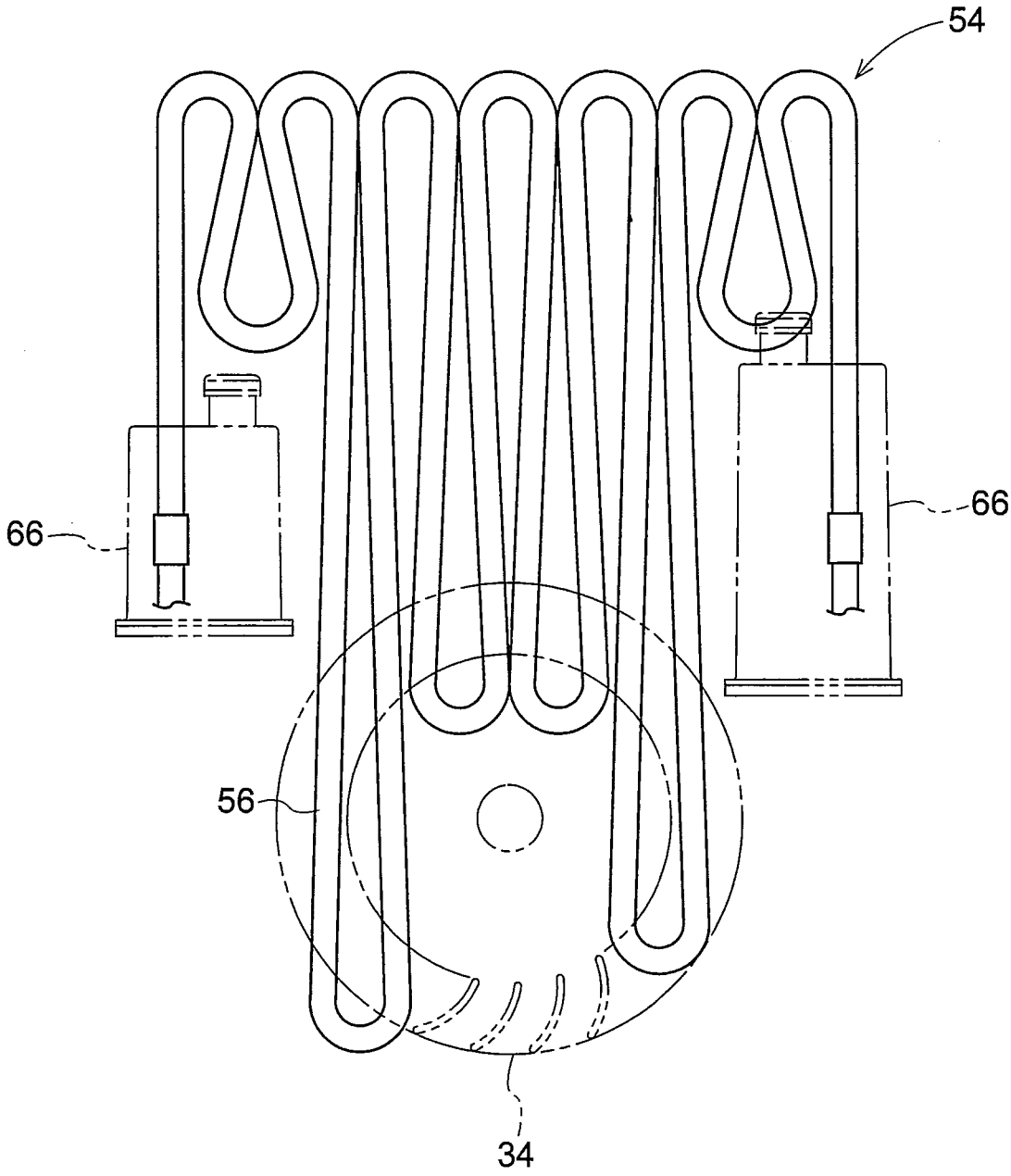

As shown in FIG. 5, the canister 66 disposed on the left side is larger than the canister 66 disposed on the right side. The canister 66 is configured to adsorb fuel gas evaporated inside the fuel tank 60 and desorb this adsorbed fuel gas during driving of the engine, so that the desorbed fuel gas may be drawn into the engine 19. Among the gas passages 61-64 extending between the fuel tanks 60 and the engine 19, the canisters 66 are incorporated in the gas passageways 62, 63, 64 disposed downstream of the evaporated gas separator tank 65. The canisters 66 are disposed in distribution in cooling air passageways 55 of the engine 19 equidistantly spaced apart on the right/left sides relative to the right/left centerline of the traveling vehicle body and at positions rearwardly of the oil cooler 54.

The cooling air passageways 55 comprise the air passageway downwardly of the ambient air introducing space 43 surrounded by the dustproof cover 42 and where the oil cooler 54 is disposed and the air passageway where air is generated by the engine cooling fan 34 to flow from the dustproof cover 42 and where the oil cooler 54 is disposed and then guided past the air passageway 55 through the air intake opening 37 toward the engine 19.

The cooling pipe 56 constituting the oil cooler 54 is folded in hairpin like manner up/down and to the right/left, and the vertical lengths of the hairpins are formed longer at the right/left center portion and are formed shorter on the right/left sides, thus decreasing the portion of the cooling pipe overlapped with the canister 66 as seen in the front view.

[During Engine Operation]

As shown in FIG. 11, the gasoline (liquid fuel) inside the fuel tank 60 is supplied to the engine 19 trough the fuel passageway 67. When ambient air is supplied to the engine 19 through the air cleaner 76, due to the negative pressure developed in association with the supplying of the air passing through the gas passageway 64 from the air cleaner 76 to the engine 19, the fuel gas which has been collected inside the canister 66 is desorbed and then drawn into the gas passageway 64 to the engine 19 via the gas passageway 63 and at the same time ambient air is introduced to the canister 66.

[During Engine Stop]

During the stopped condition of the engine 19, operation of the fuel injection apparatus (not shown) is also stopped. Therefore, the introduction of air through the gas passageway 64 from the air cleaner 76 to the engine 19 is stopped and intake of ambient air is not effected. And, when gasoline is supplied to the fuel tank 60, evaporated gas (fuel gas) present inside the fuel tank 60 is to be discharged to the outside of the tank 60. In this, according to the present embodiment, the evaporated gas is adsorbed in the canister 66 via the evaporated gas separator tank 65, whereby discharge of the evaporated gas into the atmosphere is restricted.

When there occurs a situation where the interior of the evaporated gas separator tank 65 which is normally filled with gas is filled with gasoline (liquid) through the gas passageway 61 e.g. when the riding grass mower is traveling on a slope having a sharp inclination or the mower is turned over during traveling, the discharge port will be closed by the float valve 71 inside the evaporated gas separator tank 65, whereby intrusion of the liquid gasoline into the canister 65 is prevented.

As described above, with the provision of the evaporated gas separator tank 65 upwardly of the fuel tank 60, even if gasoline (liquid fuel) flows up to the level of the evaporated gas separator tank 65 due to vehicle body inclination or the like, it is possible to separate fuel gas from gasoline (liquid fuel) within the evaporated gas separator tank 65, and send only fuel gas to the canister 66. Further, when the flow amount of the gasoline increases to fill the interior of the evaporated gas separator tank 65 with gasoline, the float of the float value 71 will float up to close the discharge port 71*a*, so that flowing of the gasoline toward the canister 66 can be effectively prevented. In general, in order to prevent movement of gasoline inside the fuel tank to the canister even when there occurs significant vehicle body inclination as a result of e.g. sudden braking, sudden start, sudden turn, traveling on a steeply inclined surface, it would be needed to raise the evaporating hose between the fuel tank and the canister high or to dispose the evaporated gas separator tank at a high position. According to the present embodiment, however, since the float valve 71 is provided inside the evaporated gas separator tank 65, the position of the evaporated gas separator tank 65 can be lowered.

Since the liquid surface level stationary float 75 is accommodated inside the evaporated gas separator tank 65, disturbance of the liquid surface level inside the evaporated gas separator tank 65 is prevented, so that the liquid surface level can always be maintained under a constant condition. With this, it becomes possible to prevent outflow of even a small amount of gasoline due to e.g. splashing of drops scattered from the liquid surface onto the float valve 71. In this way, since the fuel gas and gasoline can be separated from each other by means of the evaporated gas separator tank 65, fuel gas alone can be sent to the canister 66, thus preventing outflow of gasoline in a reliable manner. Further, even if the vehicle body overturns or falls and the interior of the evaporated gas separator tank 65 is filled with gasoline, outflow of gasoline to the side of the canister 66 can be prevented as the float valve 71 closes.

[Alternate Embodiments of First Embodiment]

(1) As the gas flow passageways 61 interconnecting the fuel tanks 60 and the evaporated gas separator tank 65, three or more of them can be provided.

(2) In the foregoing embodiment, the right/left canisters 66 are partially overlapped with the cooling pipe 56 of the oil cooler 65, as seen in the front view. Instead, the cooling pipe 56 overlapped with the canister 66 in the front view can be omitted.

Figure 14:
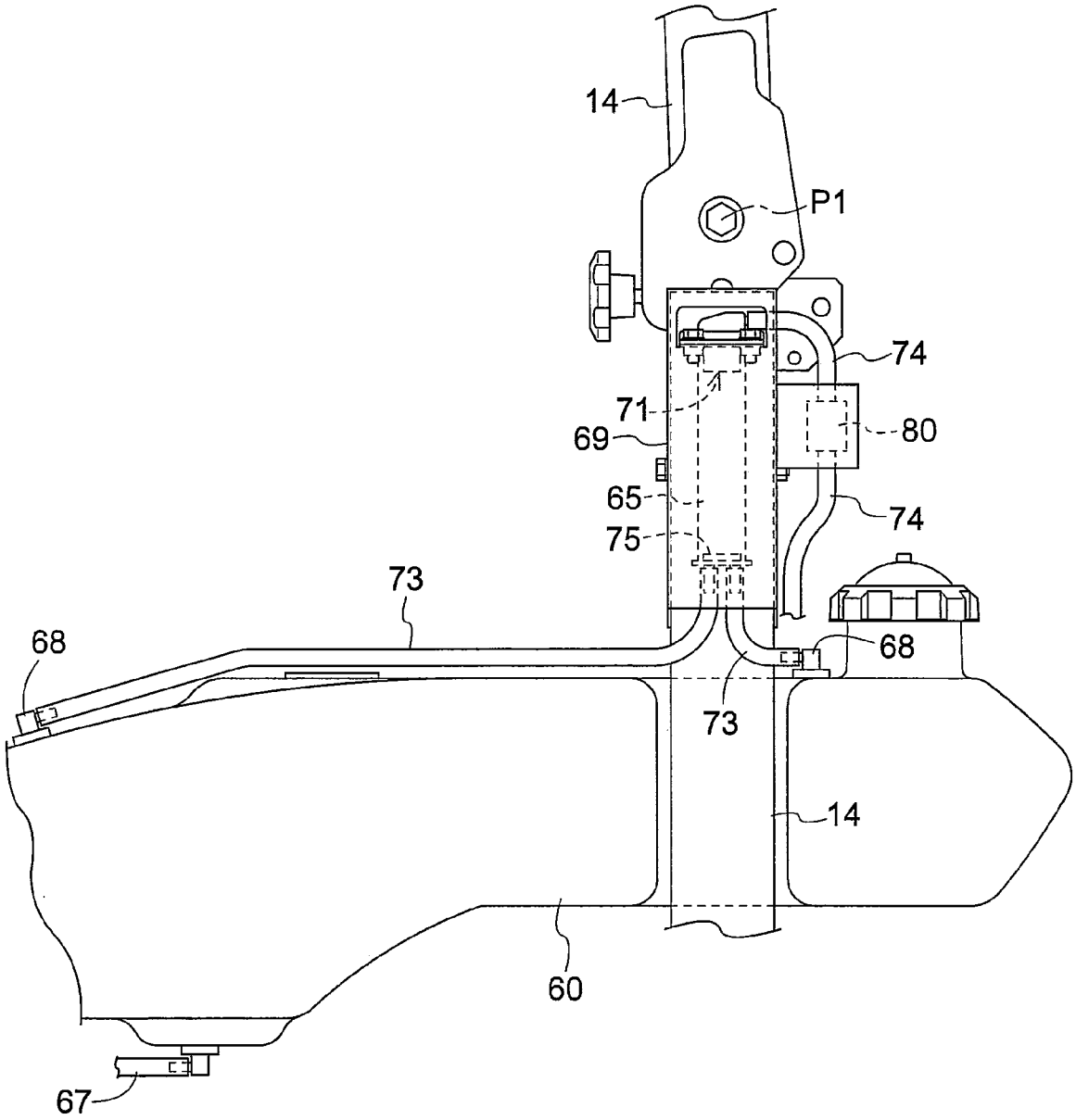
Figure 15:
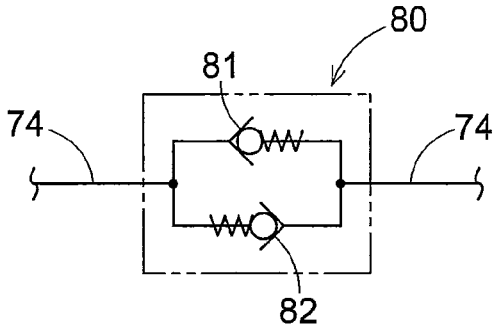

(3) FIG. 14 and FIG. 15 show a construction, relative to the construction of the foregoing embodiment, wherein a two-way valve 80 is incorporated in the gas passageway 62 (see FIG. 11) between the evaporated gas separator tank 65 having the shutoff valve (float valve 71) and the canister 66. As shown in FIG. 15, the two-way valve 80 has a construction comprising two-direction check valves 81, 82 that shut the flow until a predetermined positive or negative pressure is developed. This two-way valve 80 is switched over to allow flow in either one direction, of the flow directions of gas in the gas passageway 62, one direction allowing the flow from the evaporated gas separator tank 65 to the canister 66 or the opposite direction thereto. When the engine 19 is under operation, the valve 80 allows introduction of ambient air to the side of the fuel tank 60 from the side of the evaporated gas separator tank 65. And, in response to lowering of the liquid surface level, the ambient air is allowed to flow from the side of the canister 66 to the side of the fuel tank 60. When the engine 19 is under the stopped condition, no introduction of ambient air is effected. When liquid fuel (gasoline) is supplied, and when the interior of the fuel tank 60 becomes a closed space, the inside pressure of the fuel tank 60 rises in association with the supplying of fuel and fuel gas flows from the side of the fuel tank 60 to the side of the canister 66 to be collected by the adsorbent.

Further, with the provision of the two-way valve 80, even when the fuel inlet is located at a position higher than the top surface of the evaporated gas separator tank 65, it is possible to secure an air layer inside the evaporated gas separator tank 65 and in accordance with the inside pressure of tank of the evaporated gas separator tank 65, purging and air intake are effected automatically, so that the tank inside pressure can be stable.

Figure 16:
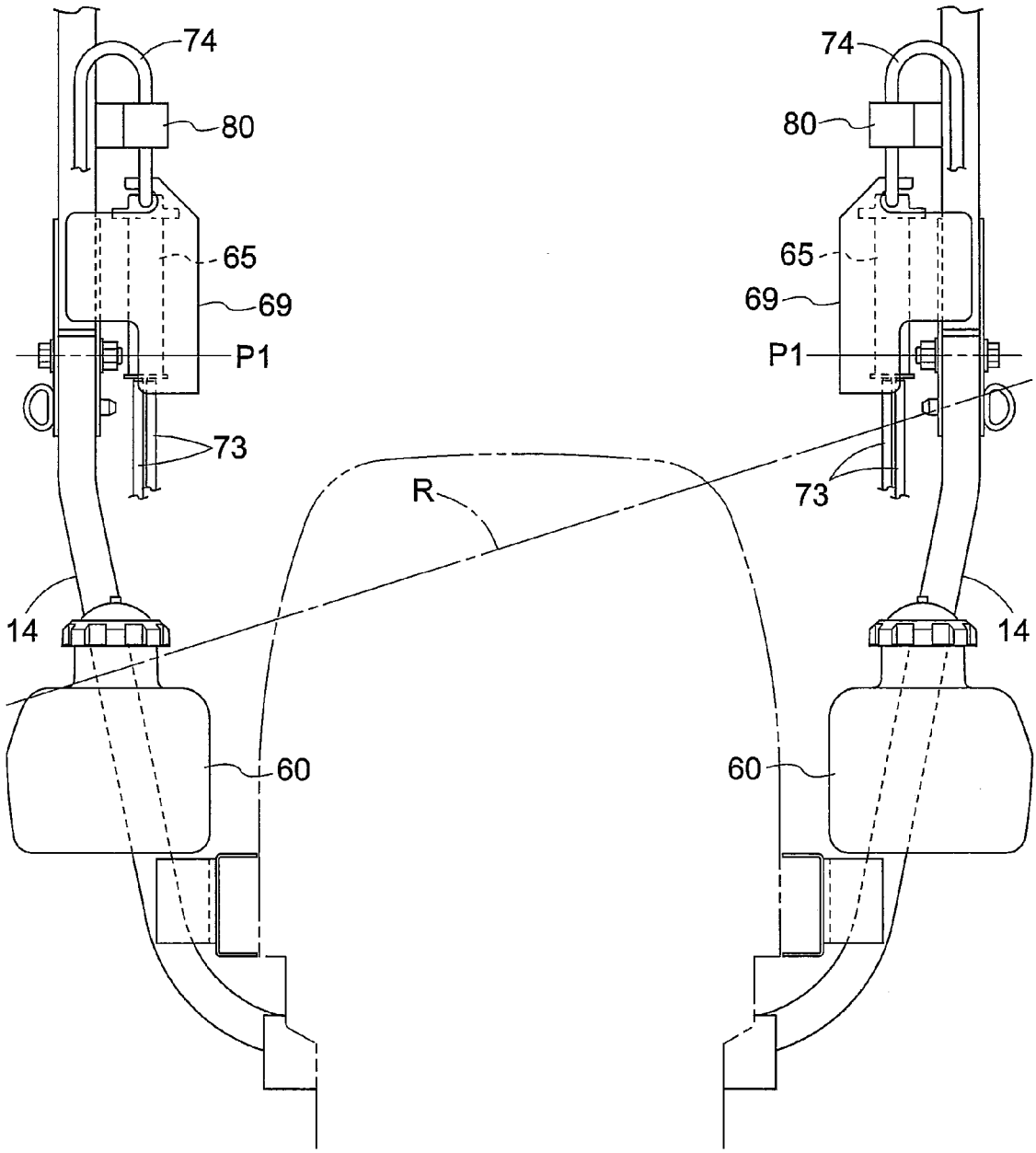
Figure 17:
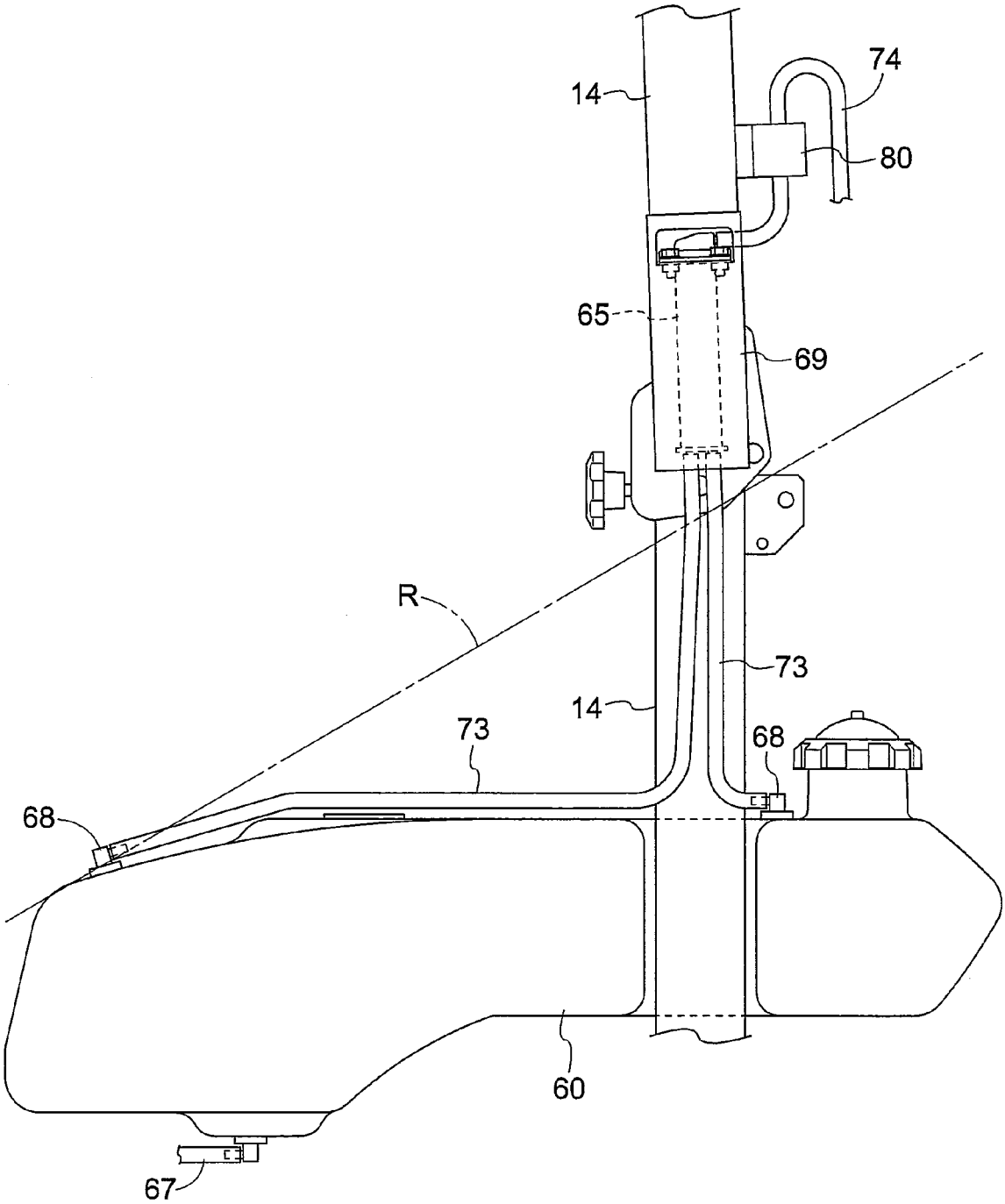

The right/left fuel tanks 60, as shown in FIG. 11, are communicated to each other via a fuel passageway 67 for supplying gasoline to the engine 19. FIG. 16 and FIG. 17 show another arrangement wherein the evaporated gas separator tank 65 is disposed at a position higher than a tank liquid surface line R relative to the position of a hose connecting member 68 of the fuel tank 60 under the maximally inclined condition of the traveling vehicle body 1. In the case of this arrangement wherein the evaporated gas separator tank 65 is disposed upwardly of the tank liquid surface line R at the time of the maximally inclined condition of the traveling vehicle body 1, the shutoff valve (float valve 71) can be omitted.

Figure 18:
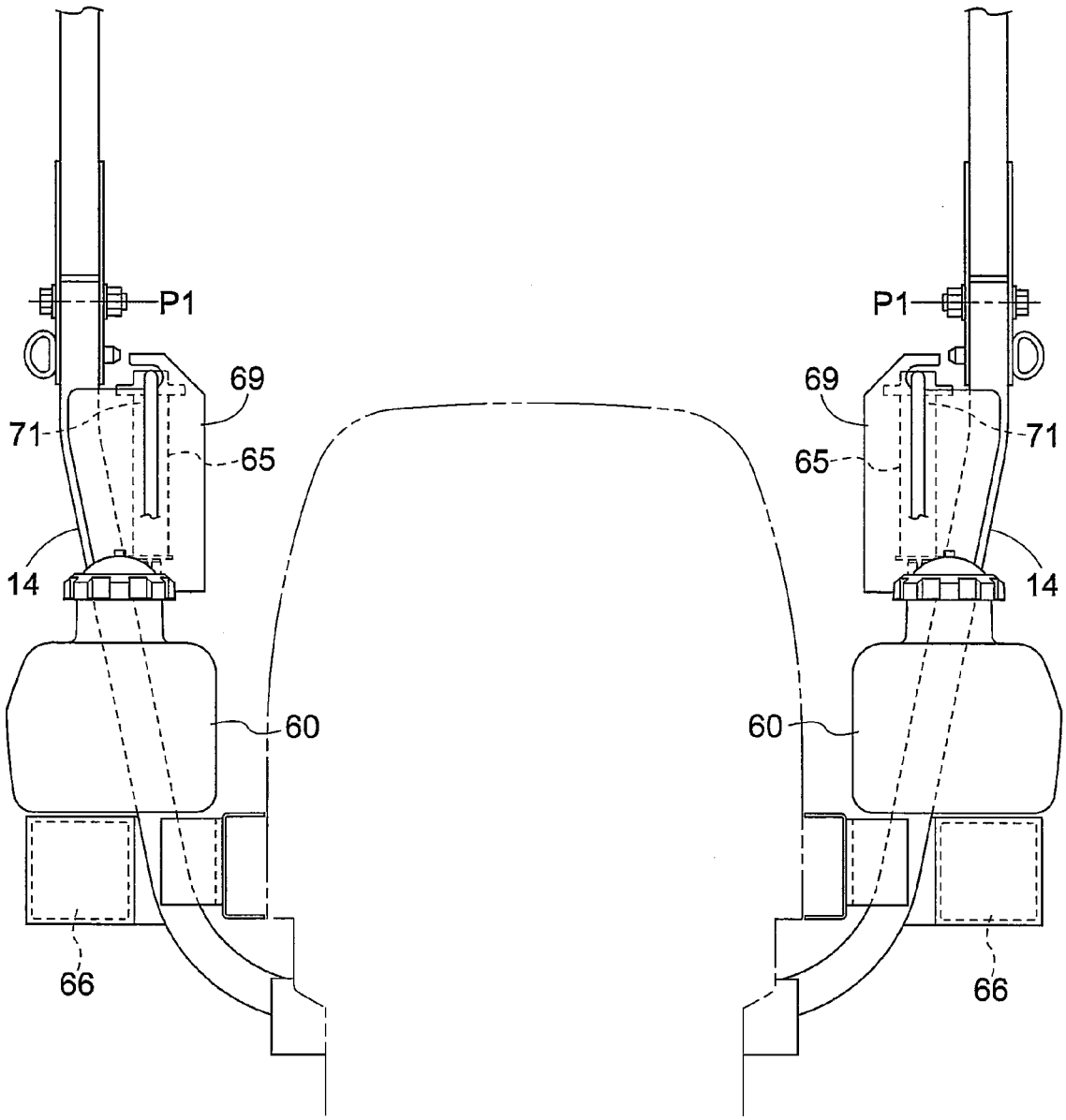
Figure 19:
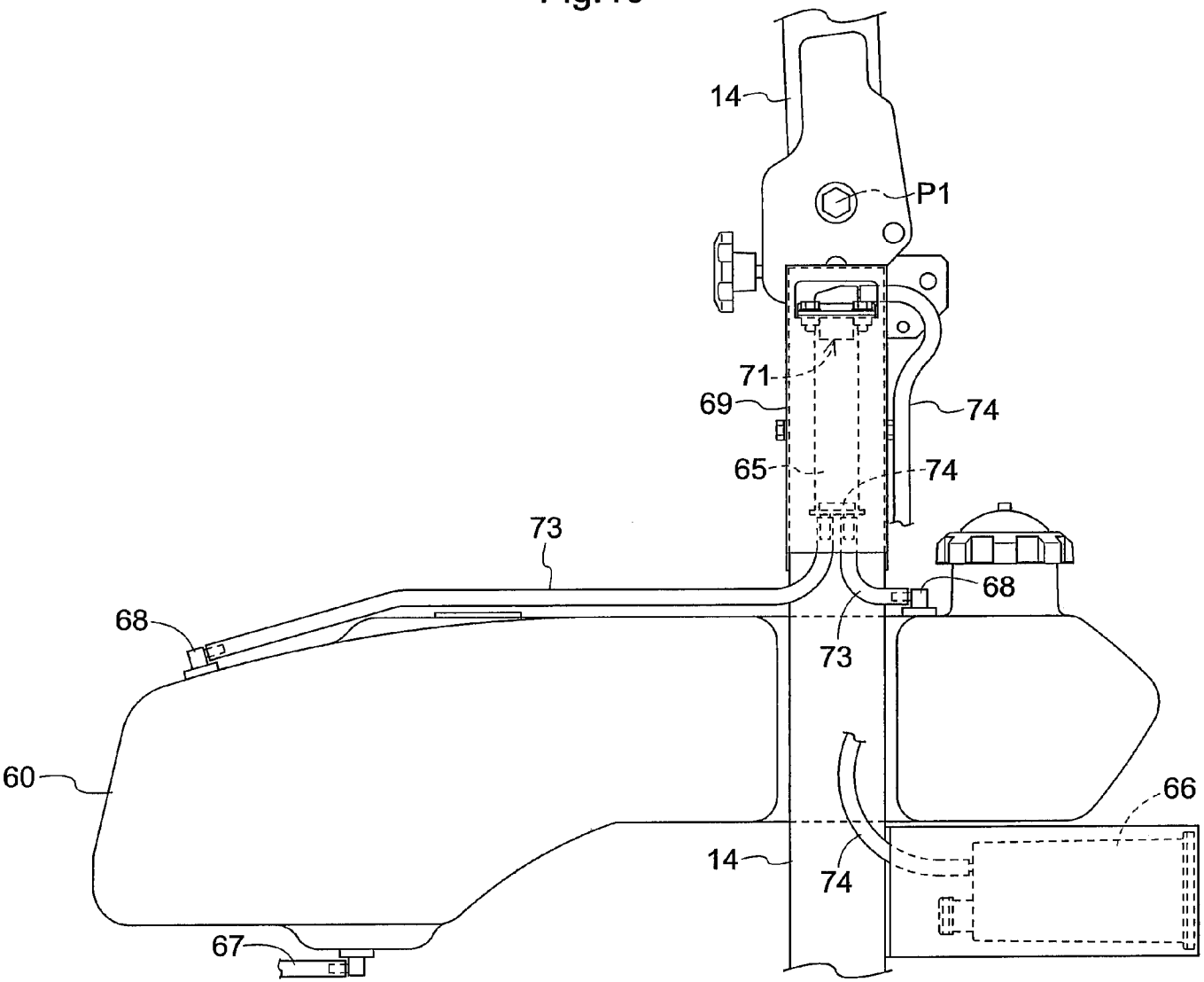

(4) FIG. 18 and FIG. 19 show a further embodiment wherein the location of the canisters 66, 66 is different compared with the foregoing embodiment. In FIG. 18 and FIG. 19, the right/left canisters 66, 66 are disposed rearwardly and downwardly of the right/left fuel tanks 60, 60.

(5) In the foregoing embodiment, there was illustrated the evaporated gas tank 65 having the liquid surface level stationary float 75. Instead, an evaporated gas separator tank 65 having the liquid surface level stationary float 75 may be employed.

[Second Embodiment]

Next, with reference to FIGS. 1-2 and FIGS. 20-25, a second embodiment will be described. In this embodiment too, like the first embodiment, the invention is applied to a riding type grass mower, an example of work vehicle, as shown in FIGS. 1-2. In comparison with the first embodiment, the second embodiment differs in that the evaporated gas separator tank 65 is not present in the gas passageway between the fuel tank 60 and the engine 19 and only one canister 66, rather than a plurality (two) of them, is provided, and so on. Respecting the identical arrangements to those in the first embodiment, explanation thereof will be partially omitted, with only identical reference marks being provided.

Figure 20:
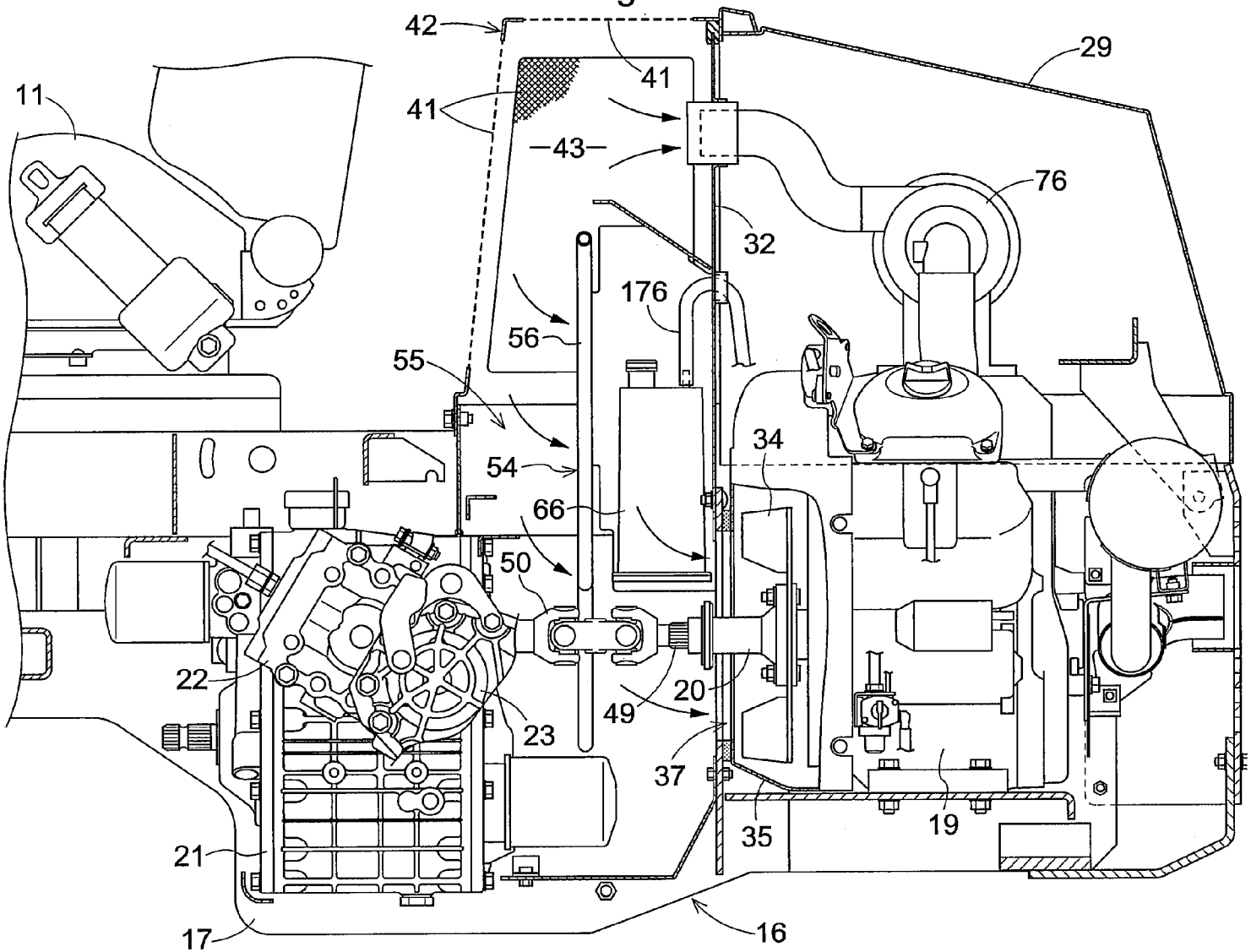
Figure 21:
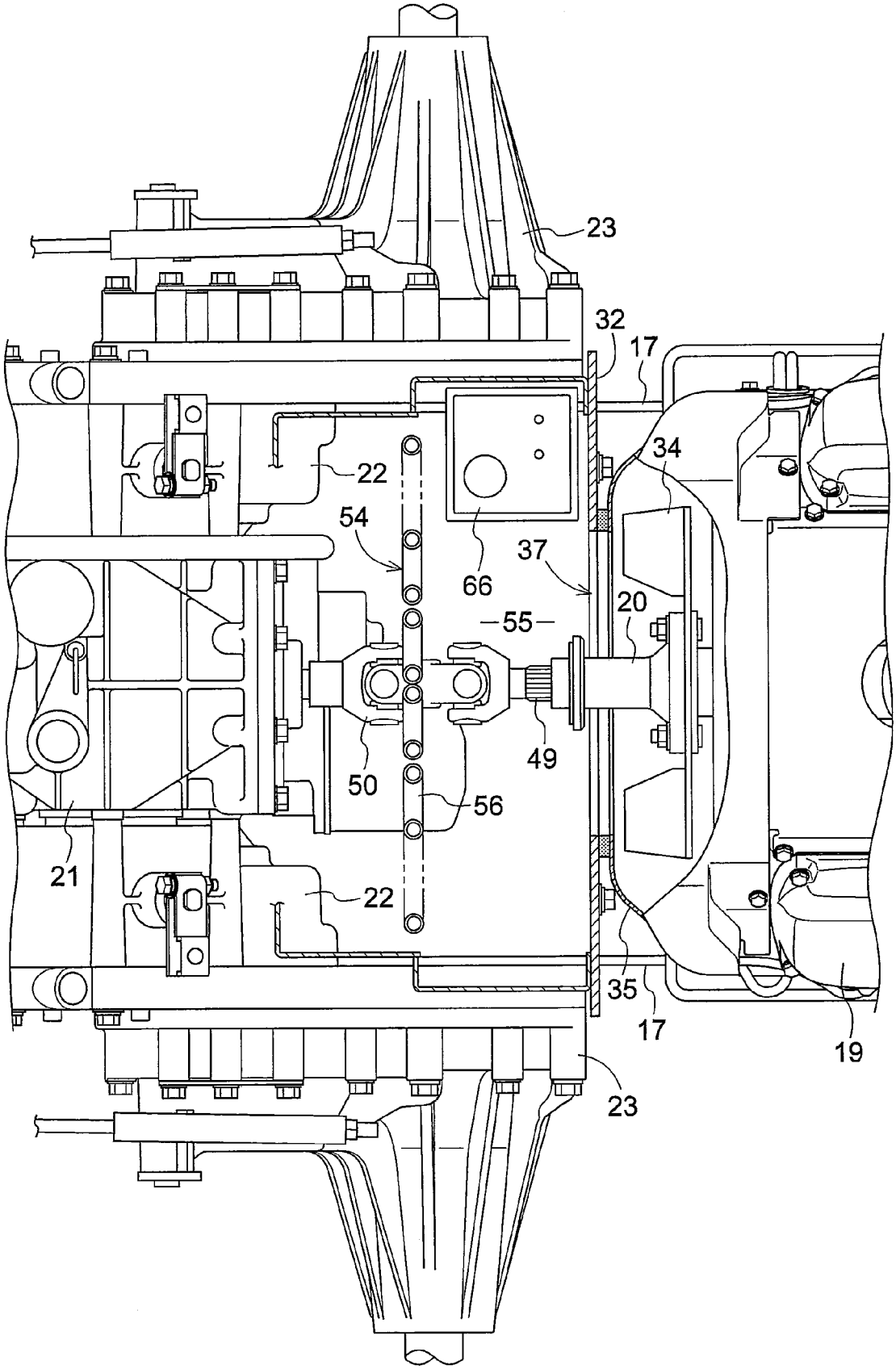

As shown in FIG. 20 and FIG. 21, the side member 17 mounts erect a partitioning wall 32 forming an engine room. To the front portion of the engine 19, there is mounted an engine cooling fan 34 which is rotatable in unison with an output shaft 20 of the engine 19. Cooling air generated by the engine cooling fan 34 is caused flow toward the engine 19 via an air introducing opening 37 having a circular shape in its front view. The air guiding housing 35 guides this cooling air from the engine cooling fan 34 to the periphery of the engine 19, thus cooling this engine 19.

Between the partitioning wall 32 at the front end of the upper cover 29 and the driver's seat 11, there is integrally provided a dustproof cover 42 having a dustproof mesh 41 for removing dust. The partitioning wall 32 and the dustproof cover 42 together form an ambient air introducing space 43, and from this ambient air introducing space 43, clean ambient air can be supplied to the air introducing opening 37 of the air guiding housing 36.

As shown in FIG. 20 and FIG. 21, power transmission from the engine 19 to the transmission apparatus 21 is effected via a transmission shaft 49 splined on the output shaft 20 to be slidable relative thereto and a pair of front/rear universal joints 50.

In the cooling air passageway 55 downwardly of the ambient air introducing space 43, there is disposed an oil cooler 54 for cooling oil which is supplied in circulation to the HST 22, the unillustrated hydraulic cylinder and hydraulic clutch. A cooling pipe 56 constituting the oil cooler 54 is bent and folded in hairpin-like manner to the right/left and upper and lower directions, and its lower side stride across the output shaft 20.

With the above-described arrangement, the oil cooler 54 can be readily cooled by the engine cooling air flowing in the ambient air introducing space 43 and the cooling air passageway 55 of the oil cooler 54. The lower portion of the oil cooler 54 draws in air present forwardly thereof and this cooling air together with the cooling air flowing in the ambient air introducing space 43 is introduced to the air introducing opening 37 of the air guiding housing 35 and supplied to the engine 19.

As shown in FIG. 1, FIG. 2, FIG. 22 and FIG. 23, downwardly and rearwardly of the right/left fenders 12, 12 and at positions upwardly of the right/left rear wheels 3, 3, there are disposed fuel tanks 60, 60 for holding gasoline therein. The right/left fuel tanks 60, 60 are shaped so as to circumvent the ROPS frame 14, and are elongate in the front/rear direction and the left fuel tank 60 has a greater capacity than the right fuel tank 60. At two front/rear positions apart from each other at front/rear ends of an upper face of the right/left fuel tanks 60, there are attached connecting members 68 for a hose 173 each acting as a connecting port.

Figure 22:
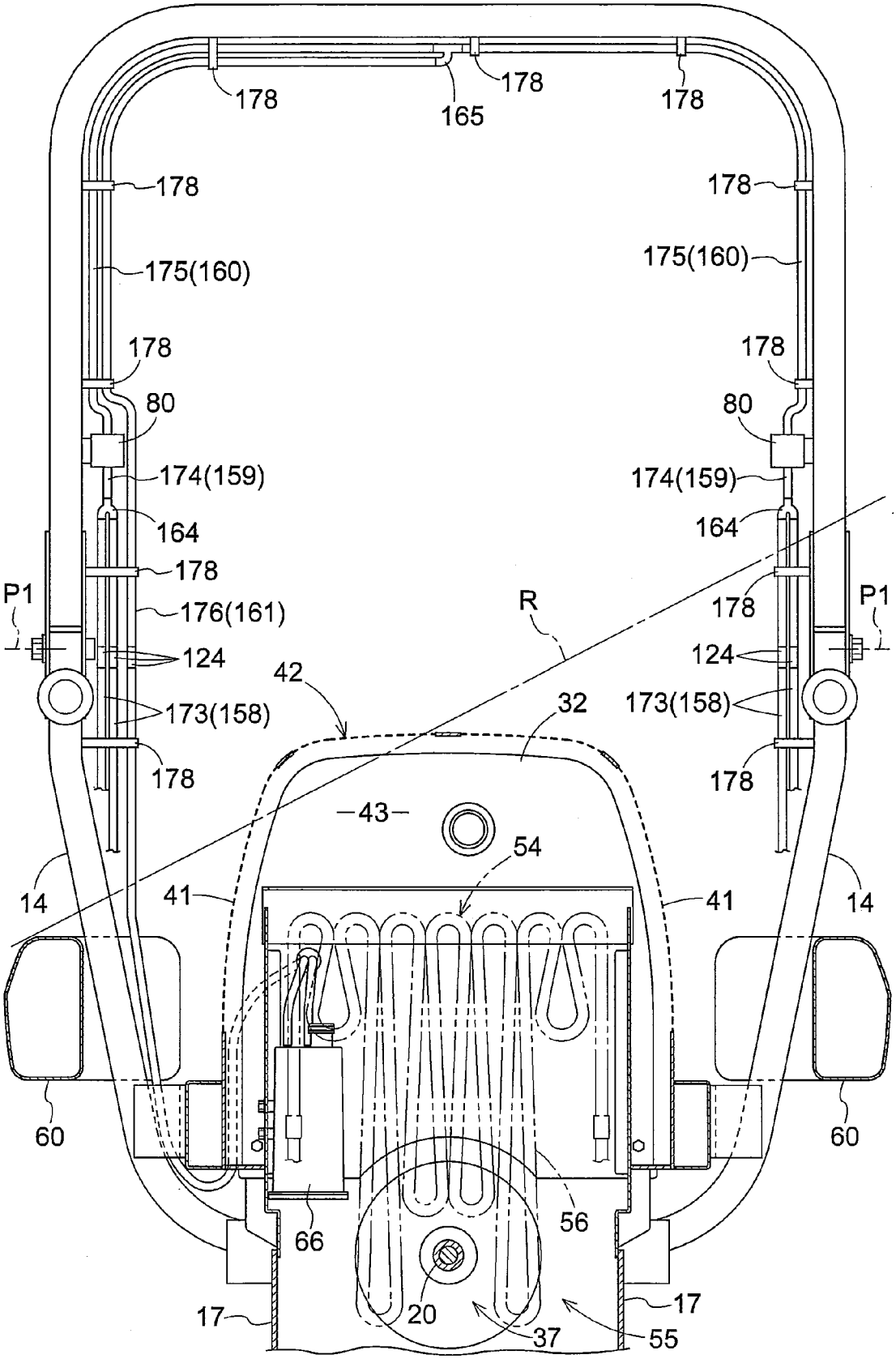
Figure 24:
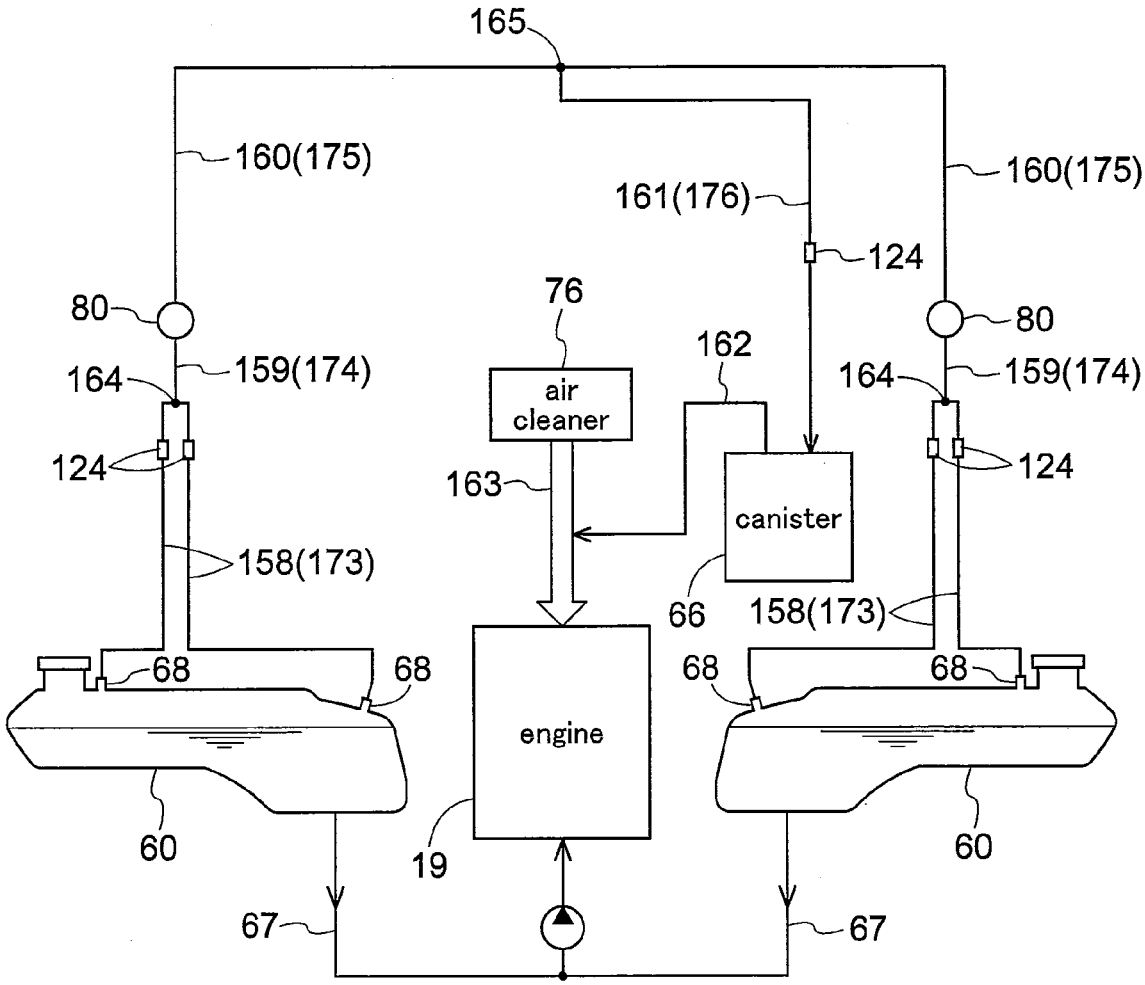
Figure 25:
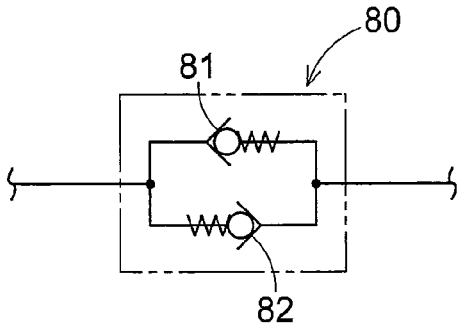

A portion of the gasoline inside the fuel tank 60 evaporates inside the tank 60. The evaporated gas (fuel gas) is drawn in during the intake stroke of the engine 19 to be combusted. FIG. 24 is a block diagram explaining flows of the ambient air and evaporated gas in the fuel supplying system. In a gas passageway 158-163 extending between the fuel tank 60 and the engine 19, there are incorporated collecting pipes 164, 165, a two-way valve 80 and a canister 66. As shown in FIGS. 20-22, the canister 66 is disposed on the right side of the ambient air introducing space 43.

The collecting pipe 164 is connected to two, front/rear evaporating hoses 173 (gas passageways 158) connected to each right/left fuel tank 60 and to one evaporating hose 174 (gas passageway 159) connected to the two-way valve 80, and is disposed at a vertical intermediate position between the right/left frame portions of the ROPS frame 14 and upwardly of the horizontal axis P1.

The collecting pipe 165 is connected to two, right/left evaporating hoses 175 (gas passageways 160) connected to each right/left two-way valve 80 and one evaporating hose 176 (gas passageway 161) connected to the canister 66, and is disposed at a right/left intermediate position of the upper end portion of the ROPS frame 14.

The evaporating hoses 173, 174, 175 are disposed along the ROPS frame 14 and are attached to the vehicle body inner side face of the outer face of the ROPS frame 14 via attaching members 178, in such a manner that the hoses are confined within the front/rear width of the ROPS frame 14 (i.e. under the condition of not projecting forwardly or rearwardly). The evaporating hose 176 connected to the collecting pipe 165 is caused to extend downward from the uppermost portion of the ROPS frame 14 along the right side portion of the ROPS frame 14 and connected to the canister 66. Between the canister 66 and the engine 19, there is connected a gas passageway 163 connected to the exhaust port of the canister 66, to the gas passageway 163 between the air cleaner 76 and the engine 19. At the portions of the evaporating hoses 173, 174, 175 adjacent the horizontal axes P1 of the ROPS frame 14, there are provided joints 124 ("quick couplers") which can be connected/disconnected. So, when the ROPS frame 14 is separated and detached at the portions of the horizontal axes P1, the evaporating hoses 173, 174, 175 can be easily separated at the portions of the joints 124.

The evaporated gas (evaporated fuel gas) generated inside the fuel tank 60 flows through the gas passageways 158-163 and is adsorbed by the canisters 66; and the fuel gas that has been desorbed from the canister 66 during the air intake stroke of the engine 19 is supplied to the cylinder of the engine 19 (this will be referred to simply as the "engine 19"). Liquid fuel (gasoline) is supplied from the fuel tank 60 through the fuel passageway 67 to the engine 19.

As the two purging hose connecting members 68 are provided at two positions in the upper face of the fuel tank 60 distant from each other in the front/rear direction, accumulation of air hardly occurs, so that the system can be construction without limitations on the tank shape, tank posture, etc.

[During Engine Operation]

As shown in FIG. 24, the gasoline (liquid fuel) inside the fuel tank 60 is supplied to the engine 19 trough the fuel passageway 67. When ambient air is supplied to the engine 19 through the air cleaner 76, due to the negative pressure developed in association with the supplying of the air passing through the gas passageway 163 from the air cleaner 76 to the engine 19, the fuel gas which has been collected inside the canister 66 is desorbed and then drawn into the gas passageway 163 to the engine 19 via the gas passageway 162 and at the same time ambient air is introduced to the canister 66. Further, as the inside pressure of the fuel tank 67 drops in association with consumption of fuel, air is introduced from the side of the canister 66 via the two-way valve 80 into the fuel tank 60. The two-way valve 80 is configured to stop the flow from the high pressure side to the low pressure side until development of a predetermined pressure difference and the check valve 81 or 82 is opened when the pressure difference exceeds the predetermined value.

[During Engine Stop]

During the stopped condition of the engine 19, operation of the fuel injection apparatus (not shown) is also stopped. Therefore, the introduction of air through the gas passageway 163 from the air cleaner 76 to the engine 19 is stopped and intake of ambient air is not effected. And, when gasoline is supplied to the fuel tank 60, the liquid surface inside the fuel tank 60 exceeds the predetermined liquid surface level, thus forming a closed space therein and in association with the rise of the liquid surface level, the inside pressure of the tank 60 rises. Therefore, with this tank's inside pressure, the two-way valve 80 is opened and the evaporated gas (fuel gas) is discharged to the side of the canister 66 and adsorbed by the canister 66 (adsorbent such as activated carbon), thus discharging of the evaporated gas into the atmosphere is effectively restricted.

When there occurs change in the liquid surface level inside the fuel tank 60 e.g. when the riding grass mower is traveling on a slope having a sharp inclination or at the time of start, stop or turning, etc. (at the time of vehicle body inclination), thus resulting in rising of the gasoline into the evaporating hose 173, since the evaporating hoses 173-176 are extended high above along the ROPS frame 14 to the vicinity of the upper end of this ROPS frame 14, intrusion of gasoline inside the fuel tank 60 into the canister 66 can be prevented.

Figure 23:
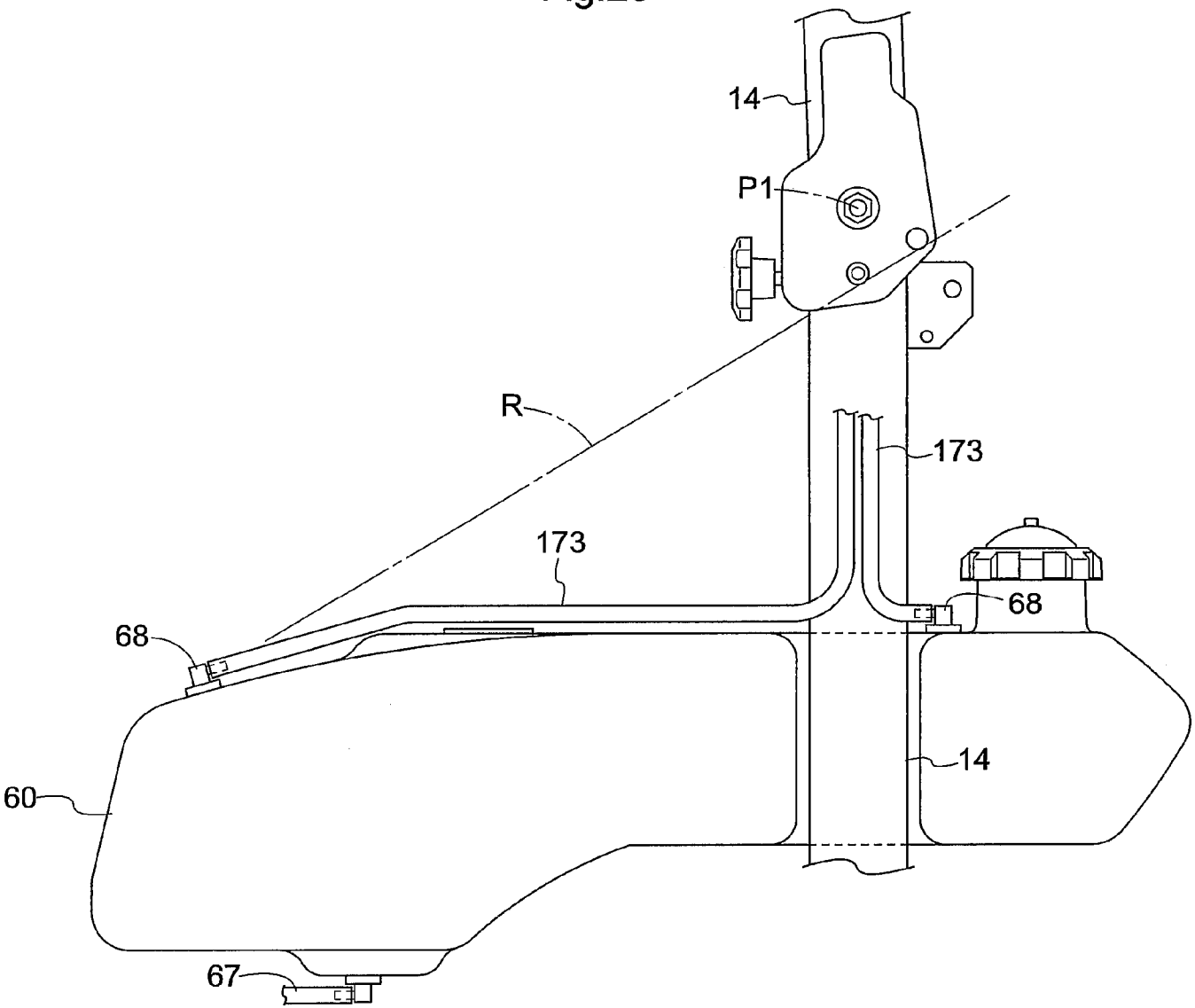

The mark R shown in FIG. 22 and FIG. 23 denotes the maximum inclined liquid surface corresponding to the overturning inclination angle (the limit angle for avoiding overturning of the self-propelled vehicle body 1, at the time of the maximum possible inclination of the self-propelled vehicle body 1) in the right/left direction and front/rear direction of the self-propelled vehicle body 1 relative to the horizontal plane. The height of the ROPS frame 14 is set to be higher than the maximum inclined liquid surface R of the liquid fuel inside the fuel tank 60 assumed at the time of the maximum possible inclination of the self-propelled vehicle body 1, and the evaporating hoses 173-177 forming the gas passageways 158-161 between the fuel tank 60 and the canister 66 are caused to extend along the ROPS frame 14 to positions higher than the maximum inclined liquid surface R.

As the right/left fuel tanks 60, 60 are communicated to each other via the fuel passageway 67, if the self-propelled vehicle body 1 is inclined to one side in the right/left direction (to the right side in the figure) when the right/left fuel tanks 60, 60 are full, gasoline will rise to the position where the hose 173 on the right side in FIG. 22 intersects the maximum inclination liquid surface R. However, as the evaporating hoses 173-175 are extended to the uppermost position of the ROPS frame 14 (the position of the collecting pipe 165), the gasoline will be prevented from reaching the canister 66 along the evaporating hoses 173-176 unless the self-propelled vehicle body 1 is overturned.

Further, as shown in FIG. 22, the collecting pipe 164 and the two-way valve 80 of the pair of evaporating hoses 173, 173 connected to the fuel tanks 60 are set at positions higher than the maximum inclined liquid surface R, even when the self-propelled vehicle body 1 is inclined to the condition of the maximum inclined liquid surface R.

As described above, since the evaporating hoses 173-175 interconnecting the fuel tank 60 and the canister 66 are extended to the upper end portion of the ROPS frame 14, even when the gasoline (liquid fuel) rises in the evaporating hoses 173-175 e.g. at the time of inclination of the vehicle body 1, this gasoline does not reach the canister 66, so only fuel gas can be sent to the canister 66.

[Alternate Embodiments of Second Embodiment]

(1) In this embodiment too, like the case of the first embodiment, two canisters 66 may be provided on the right/left sides of the self-propelled vehicle body 1.

(2) As the evaporating hose 173 directly connected to the fuel tank 60, three or more of them may be provided.

(3) In the second embodiment, there is provided the two-way valve 80. But, this two-way valve 80 may be omitted.

(4) Only one fuel tank 60 may be provided in the self-propelled vehicle body 1 and one canister 66 may be connected to this. Further, a plurality of fuel tanks 60 may be provided in the self-propelled vehicle body 1 and the same number of canisters 66 may be provided, with a single canister 66 being individually connected in correspondence with each fuel tank 60.

(5) The evaporating hoses 173-176, the collecting pipes 164, 165, the two-way valve 80 and the joints 124 may be attached via the attaching members to the vehicle body outer side face, the vehicle body front side face or the vehicle body rear side face of the outer surface of the ROPS frame 14. In case they are attached via the attaching members to the vehicle body front side face or the vehicle body rear side face in the outer surface of the ROPS frame 14, the evaporating hoses 173-176, the collecting pipes 164, 165, the two-way valve 80 and the joints 124 may be attached in such a manner that these do not project to the vehicle body outer side of the ROPS frame 14.

(6) The evaporating hoses 173-176, the collecting pipes 164, 165, the two-way valve 80 and the joints 124 may be mounted in such a manner that they are not confined within the front/rear width of the ROPS frame 14 (under the condition of these slightly projecting in the front/rear direction).

(7) All or some of the evaporating hoses 173-176, the collecting pipes 164, 165, the two-way valve 80 and the joints 124 may be disposed inside a hollow ROPS frame 14.

In addition to the mid-mount type mower having the mower 5 between the right/left front wheels 2 and the right/left rear wheels 3 of the four-wheel driven type, self-propelled vehicle body 1, the present invention can be applied also to a front mower, a tractor, an agricultural transporter vehicle, a riding type rice planting machine, etc.

What is claimed is:

1. A fuel system for a traveling vehicle having an engine mounted on a vehicle body and a rollover protection structure (ROPS) extending upward from the vehicle body, the fuel system comprising:

a fuel tank accommodating an amount of fuel;

a canister;

an evaporating hose including a first evaporating hose portion and a second evaporating hose portion for sending fuel vapor generated inside the fuel tank to the canister;

said first evaporating hose portion being connected to the fuel tank and extending upward from the fuel tank along a vertical post of the ROPS;

said second evaporating hose portion extending downward along a vertical post of the ROPS and being connected to the canister;

wherein a separator tank for separating fuel from fuel vapor is attached to the ROPS and connected to the first evaporating hose portion and the second evaporating hose portion.

2. The fuel system according to claim 1, wherein the first and second evaporating hose portions are disposed along the inner face of the vertical post.

3. The fuel system according to claim 1, wherein the vertical post comprises an upper/lower two-divided hinge-foldable construction, with the separator tank being attached to the portion downwardly of the hinge.

4. The fuel system according to claim 1, wherein a housing of the separator tank comprises a mounting bracket for mounting the separator tank to the ROPS.

5. The fuel system according to claim 1, wherein a wave-preventing float is provided on a liquid surface in the separator tank.

6. The fuel system according to claim 1, wherein a seat is disposed forwardly of the ROPS and the canister is disposed between the seat and the engine.

7. The fuel system according to claim 1, wherein the canister is disposed in a space where cooling air generated by an engine cooling fan is caused to flow.

8. The fuel system according to claim 1, wherein the canister is disposed in opposition to an outer periphery of a rear wheel and along an outer peripheral region of the rear wheel.

9. The fuel system according to claim 8, wherein the fuel tank is disposed in opposition to the outer periphery of the rear wheel and along the outer peripheral region of the rear wheel, the fuel tank being disposed adjacent the canister.

10. The fuel system according to claim 1, wherein the ROPS comprises a hollow member; and wherein the separator tank, a part of the first evaporating hose portion connected to the separator tank and a part of the second evaporating hose portion connected to the separator tank are disposed inside the ROPS.

11. A fuel system for a traveling vehicle having an engine mounted on a vehicle body and a rollover protection structure (ROPS) extending upward from the vehicle body, the fuel system comprising:

a fuel tank accommodating an amount of fuel;

a canister;

an evaporating hose including a first evaporating hose portion and a second evaporating hose portion for sending fuel vapor generated inside the fuel tank to the canister;

said first evaporating hose portion being connected to the fuel tank and extending upward from the fuel tank along a vertical post of the ROPS;

said second evaporating hose portion extending downward along a vertical post of the ROPS and being connected to the canister; and a separator tank for separating fuel from fuel vapor;

wherein the ROPS comprises a hollow member; and wherein the separator tank, a part of the first evaporating hose portion connected to the separator tank and a part of the second evaporating hose portion connected to the separator tank are disposed inside the ROPS.

* * * * *